US006410478B1

(12) United States Patent
Torii et al.

(10) Patent No.: US 6,410,478 B1
(45) Date of Patent: Jun. 25, 2002

(54) REVERSIBLE THERMOSENSITIVE RECORDING MEDIUM

(75) Inventors: Masafumi Torii, Shizuoka; Hiroaki Matsui, Shizuoka; Masaru Shimada, *deceased*, late of Shizuoka, all of (JP), by Mitsuko Shimada, legal representative

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/655,505

(22) Filed: Sep. 5, 2000

(30) Foreign Application Priority Data

Sep. 6, 1999 (JP) ..... 11-251378

(51) Int. Cl.[7] ..... B41M 5/30
(52) U.S. Cl. ..... 503/201; 503/205
(58) Field of Search ..... 503/201, 205

(56) References Cited

U.S. PATENT DOCUMENTS

| | | | | |
|---|---|---|---|---|
| 5,143,893 | A | 9/1992 | Mochizuki et al. | 503/227 |
| 5,144,334 | A | 9/1992 | Suzuki et al. | 346/1.1 |
| 5,306,687 | A | 4/1994 | Furuya et al. | 503/207 |
| 5,380,693 | A | 1/1995 | Goto | 503/200 |
| 5,403,810 | A | 4/1995 | Sawamura et al. | 503/201 |
| 5,472,931 | A | 12/1995 | Morohoshi et al. | 503/227 |
| 5,489,501 | A | 2/1996 | Torii et al. | 430/341 |
| 5,521,138 | A | 5/1996 | Shimada et al. | 503/209 |
| 5,532,201 | A | 7/1996 | Goto | 503/213 |
| 5,547,500 | A | 8/1996 | Tsutsui | 106/21 A |
| 5,641,724 | A | 6/1997 | Yamaguchi et al. | 503/221 |
| 5,703,005 | A | 12/1997 | Torii et al. | 503/201 |
| 5,739,077 | A | 4/1998 | Goto et al. | 503/200 |
| 5,741,752 | A | 4/1998 | Goto et al. | 503/221 |
| 5,866,505 | A | 2/1999 | Furuya et al. | 503/201 |
| 5,868,821 | A | 2/1999 | Torii et al. | 106/31.17 |
| 5,891,823 | A | 4/1999 | Torii et al. | 503/216 |
| 5,932,516 | A | 8/1999 | Torii et al. | 503/216 |
| 5,942,377 | A | 8/1999 | Torii et al. | 430/338 |
| 5,955,225 | A | 9/1999 | Furuya et al. | 430/19 |
| 5,981,115 | A | 11/1999 | Furuya et al. | 430/19 |
| 5,981,429 | A | 11/1999 | Kawamura et al. | 503/207 |
| 6,001,159 | A | 12/1999 | Furuya et al. | 106/31.17 |

*Primary Examiner*—Bruce H. Hess
(74) *Attorney, Agent, or Firm*—Cooper & Dunham LLP

(57) ABSTRACT

A reversible thermosensitive recording medium has a support, and a reversible thermosensitive recording layer formed thereon containing a reversible thermosensitive coloring composition of an electron-donating coloring compound and an electron-accepting compound, capable of reversibly assuming a color-developed state or a decolorized state, and a decolorization accelerating agent of formula (I):

(I)

wherein p is an integer of 0 to 3; q and r are each independently an integer of 1 to 3; $X^1$, $X^2$, and $X^3$ are each a bivalent hetero-atom-containing group; $R^1$, $R^2$, and $R^3$ are each a hydrocarbon group with 1 to 22 carbon atoms, provided that at least one of $R^1$, $R^2$ or $R^3$ is an aliphatic hydrocarbon group having 8 or more carbon atoms; and $R^4$ is a hydrogen atom, hydroxyl group or an aliphatic hydrocarbon group having 1 to 8 carbon atoms. The above recording medium is used as an image display medium in an image display apparatus, and as a rewritable paper.

19 Claims, 1 Drawing Sheet

REVERSIBLE THERMOSENSITIVE RECORDING MEDIUM

BACKGROUND OF THE INVENTION

1. Field of the Invention

The present invention relates to a reversible thermosensitive recording medium comprising a reversible thermosensitive coloring composition which comprises an electron-donating coloring compound and an electron-accepting compound, and is capable of inducing color formation by utilizing the coloring reaction between the electron-donating compound and the electron-accepting compound. The recording medium is therefore capable of repeatedly forming a colored image therein and erasing the same therefrom by controlling the thermal energy applied thereto.

2. Discussion of Background

There is conventionally known a thermosensitive recording medium utilizing the coloring reaction between an electron-donating coloring compound (hereinafter referred to as a coloring agent or leuco dye) and an electron-accepting compound (hereinafter referred to as a color developer). This kind of thermosensitive recording medium is widely used, for example, in a facsimile machine, a word processor, and a printer of a scientific measuring instrument. However, the coloring reaction of the conventional thermosensitive recording medium of this type has no reversibility, so that color development and decolorization cannot be alternately repeated.

Among published patents, a recording medium capable of reversibly carrying out the color development and decolorization is also proposed. For example, a thermosensitive recording medium using phloroglucinol and gallic acid in combination as color developers is disclosed in Japanese Laid-Open Patent Application 60-193691. There is disclosed in Japanese Laid-Open Patent Application 61-237684 a reversible thermosensitive recording medium which employs compounds such as phenolphthalein and thymolphthalein as color developers. In Japanese Laid-Open Patent Applications 62-138556, 62-138568, and 62-140881, there are disclosed reversible thermosensitive recording media, each comprising a recording layer which contains a homogeneously dissolved composition of a coloring agent, a color developer, and a carboxylic acid ester. Further, in Japanese Laid-Open Patent Application 63-173684, a reversible thermosensitive recording medium comprising as a color developer an ascorbic acid derivative is disclosed. In addition, a reversible thermosensitive recording medium comprising as a color developer a salt of bis(hydroxy-phenyl)acetic acid or gallic acid, and a higher aliphatic amine is disclosed in Japanese Laid-Open Patent Applications 2-188293 and 2-188294.

Further, the inventors of the present invention proposed a reversible thermosensitive coloring composition which comprises an organic phosphoric acid compound, an aliphatic carboxylic acid compound, or a phenol compound, each having a long-chain aliphatic hydrocarbon group therein, as a color developer, and a leuco dye as a coloring agent, as disclosed in Japanese Laid-Open Patent Application 5-124360. By use of such a reversible thermosensitive coloring composition, the color development and the decolorization can be easily carried out by controlling the heating and cooling conditions for the coloring composition, and further, the color-developed state and the decolorized state can be stably maintained at room temperature, and the color development and the decolorization can be alternately repeated in a stable condition. In this application, there is also proposed a reversible thermosensitive recording medium which comprises a recording layer containing the above-mentioned reversible thermosensitive coloring composition. The present invention is based on the invention disclosed in Japanese Laid-Open Patent Application 5-124360, which has been issued as Japanese Patent No. 2981558, U.S. Pat. Nos. 5,395,433, 5,432,534, and 5,296,439, DP No. 69120645, and FP E 0492628.

Further, the use of a phenol compound having a long-chain aliphatic hydrocarbon group with a specific structure as the color developer is proposed in Japanese Laid-Open Patent Application 6-210954.

However, the above-mentioned conventional reversible thermosensitive recording media have the drawbacks that the image density is decreased and the printed image is deformed as image formation and erasure is repeated under the practical conditions. Namely, the color development and decolorization characteristics peculiar to each coloring composition cannot be constantly exhibited during the repeated operations. This is because not only the thermal energy, but also a mechanical stress is applied to the recording medium when thermal printing is carried out using a thermal head. The result is that the structures of the layers constituting the recording medium, such as a recording layer and a protective layer, are unfavorably damaged during the repeated operations.

To solve the above-mentioned problem, Japanese Laid-Open Patent Application 6-340171 aims to improve the repeated use durability of the recording medium by adding particles to the recording layer, the particles having an average particle size that is 1.1 times the thickness of the recording layer. Japanese Laid-Open Patent Application 8-156410 discloses a reversible thermosensitive recording medium which comprises a protective layer with a specific glossiness and surface roughness in order to improve the head-matching properties, and repeated use durability.

Even though the above-mentioned recording layer or protective layer is employed, the damage of these layers cannot be completely prevented during the repeated image formation and erasure operations. As a result, the surface of the recording medium is bruised by the application of thermal energy and mechanical stress in the repeated use, so that the printing quality is impaired. Therefore, the permissible number of repeated operations of image formation and erasure is limited in the practical use.

Furthermore, the recording medium is usually irradiated with light while operated and stored. In view of this, the recording medium is required to have high light resistance to such a degree that the color development and decolorization characteristics do not deteriorate by exposure to light. However, in fact, when the recording medium is exposed to a fluorescent lamp or sunlight for a long time, color change occurs at a colored image portion and a background portion. In particular, there is a tendency that the colored image is not thoroughly erased, and faintly remains after image erasure operation.

Japanese Laid-Open Patent Applications 8-310128, 9-272262, 9-270563, 9-300817, and 9-300820 propose the addition of a specific decolorization accelerating agent to the recording layer in order to obtain instantaneous decolorization properties. However, there are the problems that a colored image is not perfectly erased when an electron-accepting compound for causing the reversible color change and a binder agent are replaced. Further, no improvement is observed in the characteristics of the decolorization initiating temperature and the decolorization temperature range.

SUMMARY OF THE INVENTION

Accordingly, a first object of the present invention is to provide a reversible thermosensitive recording medium with instantaneous decolorization properties, excellent color development properties, and preservation stability, and repeated use durability without causing no bruise on the surface of the recording medium.

A second object of the present invention is to provide an image display apparatus using the above-mentioned reversible thermosensitive recording medium.

A third object of the present invention is to provide an image display method using the above-mentioned reversible thermosensitive recording medium as a rewritable paper.

The above-mentioned first object of the present invention can be achieved by a reversible thermosensitive recording medium comprising a support, and a reversible thermosensitive recording layer formed thereon comprising:

a reversible thermosensitive coloring composition comprising an electron-donating coloring compound and an electron-accepting compound, which composition is capable of inducing color formation in the electron-donating coloring compound, capable of reversibly assuming a color-developed state or a decolorized state, depending upon the temperature of the reversible thermosensitive coloring composition when heated, and/or the cooling rate of the reversible thermosensitive coloring composition when cooled after the heating thereof, and a decolorization accelerating agent represented by formula (I):

(I)

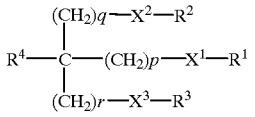

wherein p is an integer of 0 to 3; q and r are each independently an integer of 1 to 3; $X^1$, $X^2$, and $X^3$ are each a bivalent hetero-atom-containing group; $R^1$, $R^2$, and $R^3$ are each a hydrocarbon group having 1 to 22 carbon atoms, provided that at least one of $R^1$, $R^2$, or $R^3$ is an aliphatic hydrocarbon group having 8 or more carbon atoms; and $R^4$ is a hydrogen atom, hydroxyl group, or an aliphatic hydrocarbon group having 1 to 8 carbon atoms.

The above-mentioned reversible thermosensitive recording medium is found to have quick response to the change of applied thermal energy, thereby achieving instantaneous decolorization. Further, the preservation stability, in particular, thermal stability of the recording medium is remarkably improved.

The second object of the present invention can be achieved by an image display apparatus for displaying an image, using as an image display medium the above-mentioned reversible thermosensitive recording medium.

The third object of the present invention can be achieved by an image display method for displaying an image on the above-mentioned reversible thermosensitive recording medium, comprising the step of forming an image in the above-mentioned recording medium corresponding to the output information in such a manner that heat is imagewise applied to the recording medium.

The above-mentioned image display method may further comprise the step of erasing the displayed image in such a manner that heat is applied to the recording medium.

According to the image display method, information can be repeatedly recorded in the reversible thermosensitive recording medium and erased therefrom, so that the reversible thermosensitive recording medium can be used as a rewritable paper.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
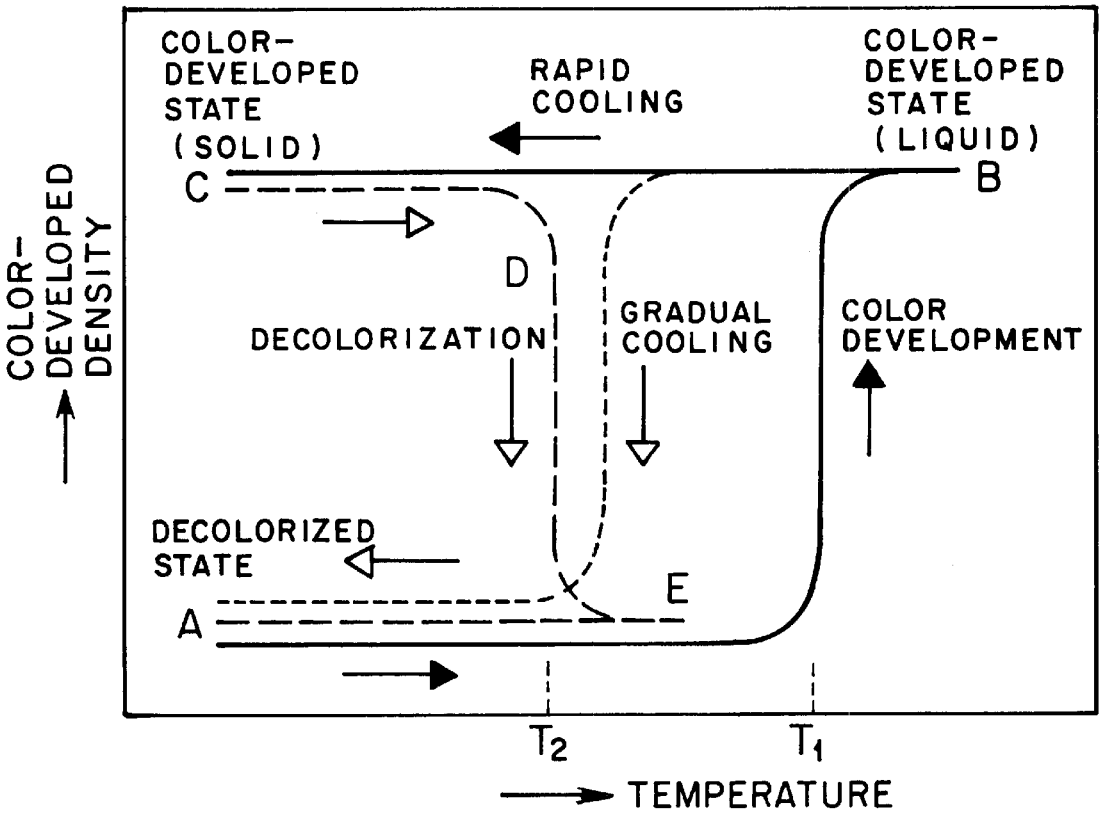
FIG. 1 is a diagram showing the color development and decolorization properties of a reversible thermosensitive coloring composition for use in the present invention depending on the temperature thereof.

In the above-mentioned formula (I) of a decolorization accelerating agent for use in the present invention, $R^1$, $R^2$, and $R^3$ are each a hydrocarbon group having 1 to 22 carbon atoms. In this case, a straight-chain or branched aliphatic group may be employed, and an unsaturated bond may be contained. Further, at least one of $R^1$, $R^2$, or $R^3$ is an aliphatic hydrocarbon group having 8 or more carbon atoms.

Specific examples of the hydrocarbon group represented by $R^1$, $R^2$, and $R^3$ are as follows:

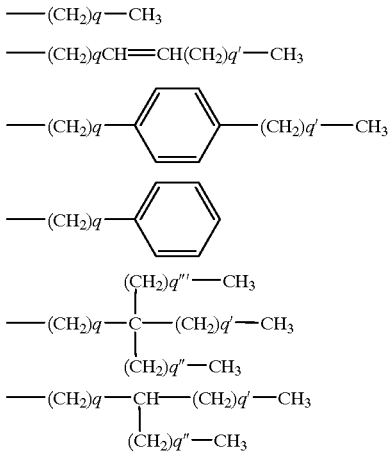

In the above, q, q', q'', and q''' are each an integer that can satisfy the number of carbon atoms contained in the hydrocarbon group represented by $R^1$, $R^2$, and $R^3$.

In particular, when $R^1$, $R^2$, and $R^3$ are each a straight-chain aliphatic hydrocarbon group, the decolorization properties can be effectively improved.

In formula (I), $R^4$ is a hydrogen atom, hydroxyl group, or an aliphatic hydrocarbon group having 1 to 8 carbon atoms. When $R^4$ is an aliphatic hydrocarbon group, a straight-chain or branched aliphatic hydrocarbon group may be employed, and an unsaturated bond may be contained.

Preferable examples of the aliphatic hydrocarbon group represented by $R^4$ are as follows:

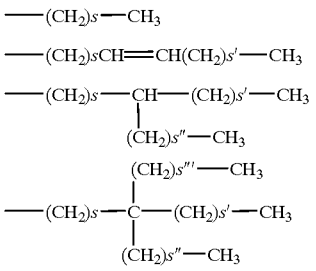

In the above, s, s', s", and s'" are each an integer that can satisfy the number of carbon atoms contained in the aliphatic hydrocarbon group represented by $R^4$.

Further, $X^1$, $X^2$, and $X^3$ are each a bivalent hetero-atom-containing group. It is preferable that the bivalent group represented by $X^1$, $X^2$, and $X^3$ comprise at least one group selected from the following five groups:

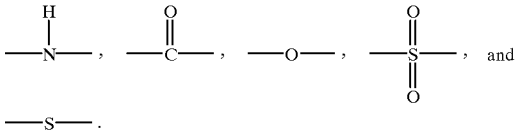

Specific examples of the bivalent group represented by $X^1$, $X^2$, and $X^3$ are as follows:

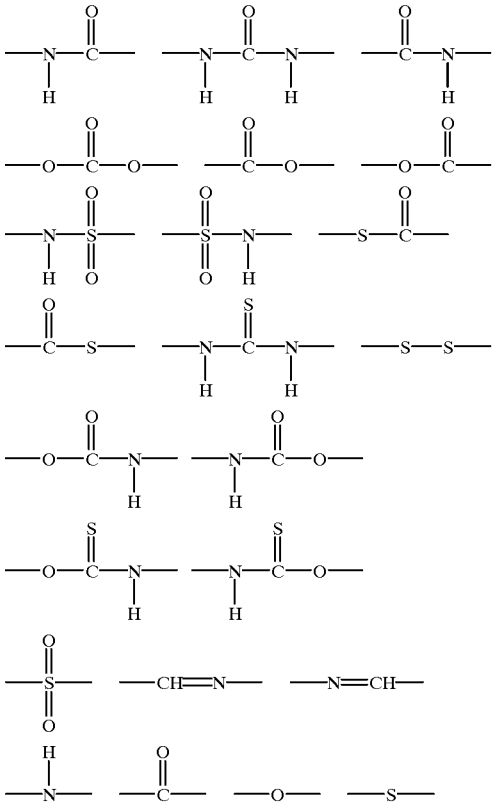

-continued

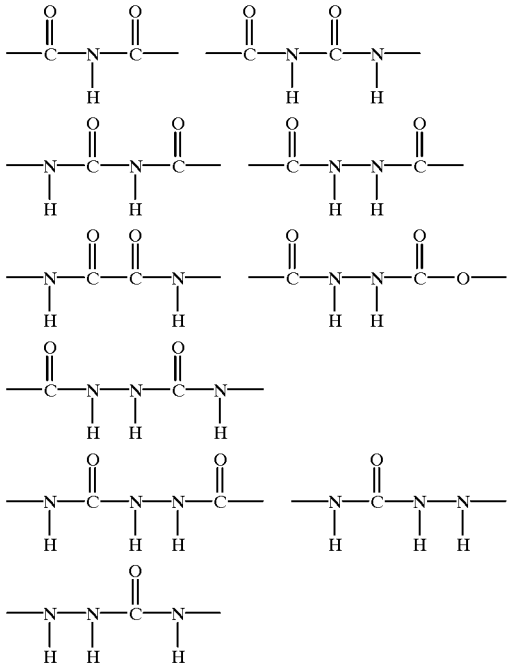

In formula (I), p is an integer of 0 to 3, and q and r are each independently an integer of 1 to 3. When p is 0, and q and r are each an integer of 1, the decolorization properties are particularly improved. In light of further improvement of the decolorization properties, it is preferable that $R^1$, $R^2$, and $R^3$ represent the same straight-chain aliphatic hydrocarbon group.

Specific examples of the decolorization accelerating agent represented by formula (I) are as follows:

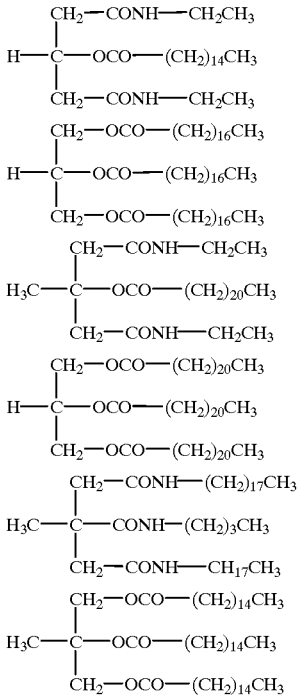

-continued
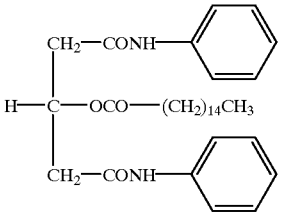
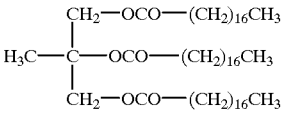
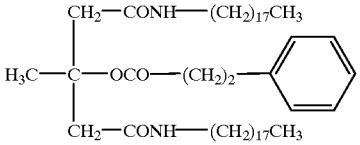
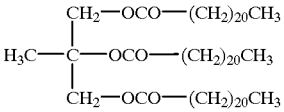
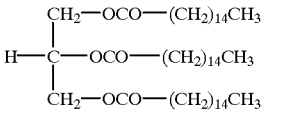
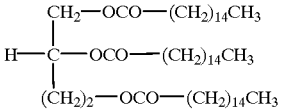
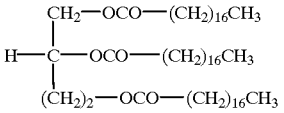
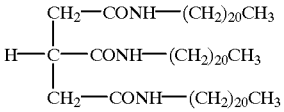
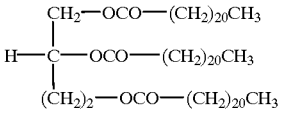
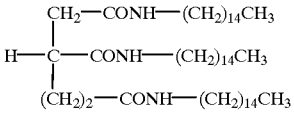
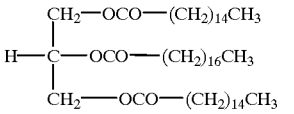
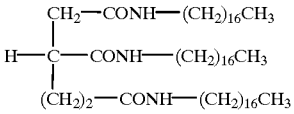
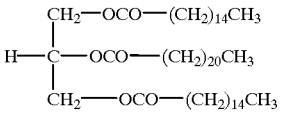
-continued
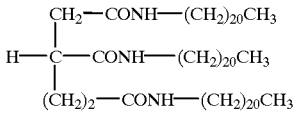
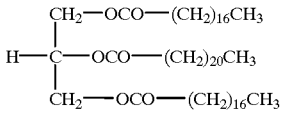
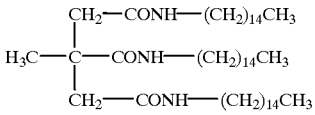
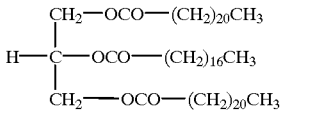
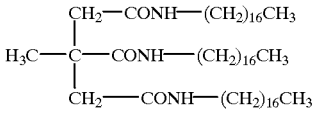
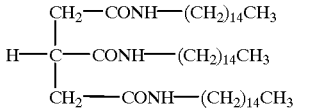
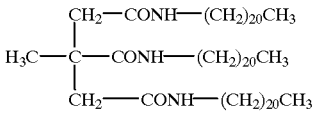
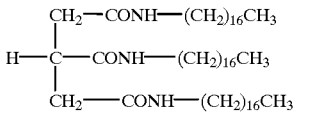
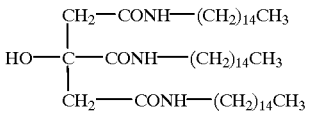
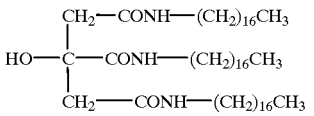
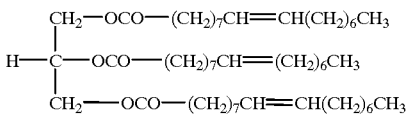
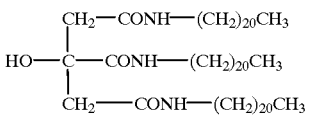
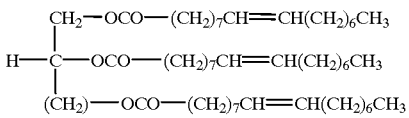
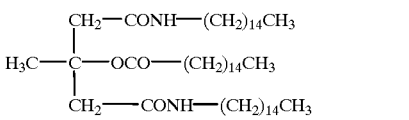

-continued

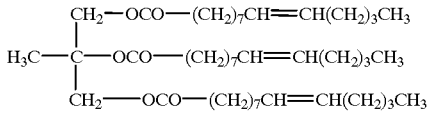

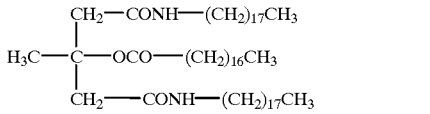

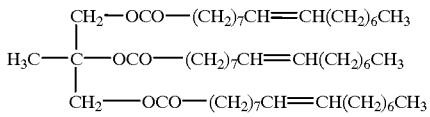

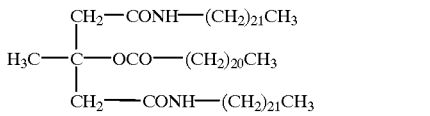

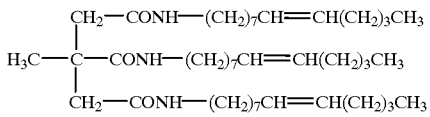

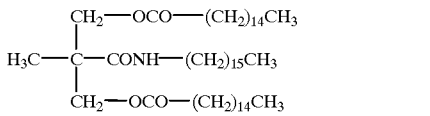

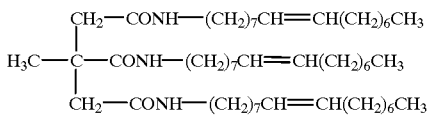

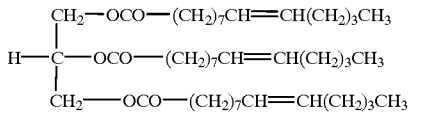

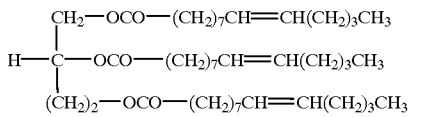

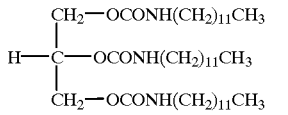

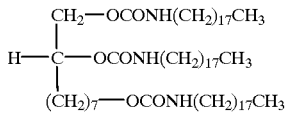

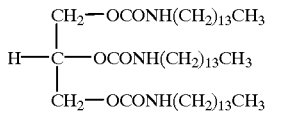

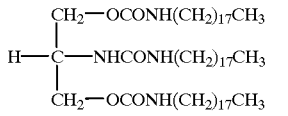

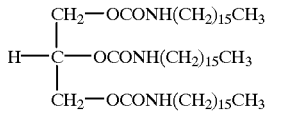

-continued

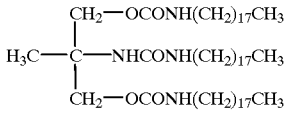

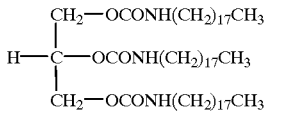

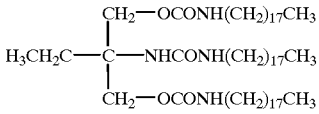

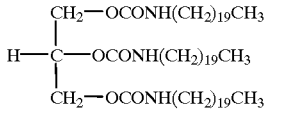

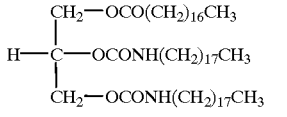

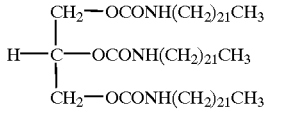

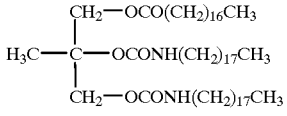

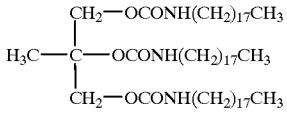

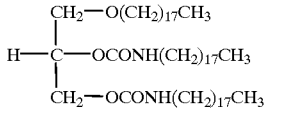

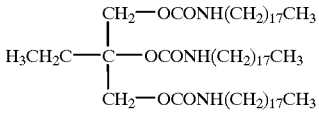

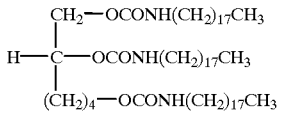

Furthermore, when a color development and decolorization controlling agent represented by the following formula (A) is used in combination with the above-mentioned decolorization accelerating agent of formula (I), the preservation stability of the recording medium is improved, and the decolorization can be more quickly carried out.

$$(R^{12})_j X^{11}—R^{11}—(X^{12}—R^{13})_k (X^{13})_l \quad (A)$$

wherein $X^{11}$, $X^{12}$, and $X^{13}$ are each a hetero-atom-containing group; $R^{11}$, $R^{12}$, and $R^{13}$ are each a group having 1 to 22 carbon atoms, which may include a heterocyclic ring therein; j and l are each independently an integer of 0 or 1; and k is an integer of 0 to 4, provided that j, k, and l are not zero at the same time, and that when k is 2 or more, $R^{13}$ and $X^{12}$ may independently be the same or different.

$R^{11}$, $R^{12}$, and $R^{13}$ are each a hydrocarbon group which may have a substituent such as hydroxyl group, a halogen atom, or an alkoxyl group. An aliphatic or aromatic hydrocarbon group is usable, and the hydrocarbon group may comprise an aliphatic hydrocarbon group and an aromatic hydrocarbon group in combination. The aliphatic hydrocarbon group may be a straight-chain one or a branched one, and contain an unsaturated bond therein.

In the compound of formula (A), it is preferable that the total number of carbon atoms included in $R^{11}$, $R^{12}$, and $R^{13}$ be 8 or more, and more preferably 11 or more because the color development becomes more stable, and the decolorization properties become better.

Preferable examples of the bivalent hydrocarbon group represented by $R^{11}$, and $R^{13}$ (when k=1) are as follows:

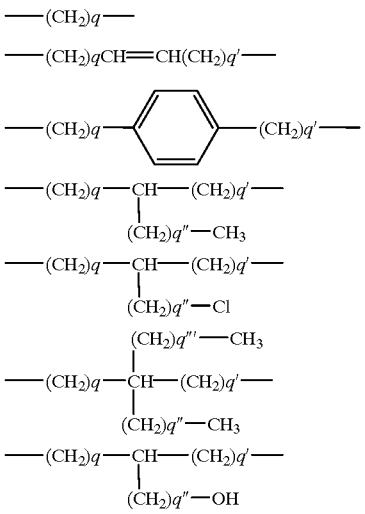

Preferable examples of the monovalent hydrocarbon group represented by $R^{12}$ (when j=1), R" (when k=l=0), and $R^{13}$ (when l=0) are as follows:

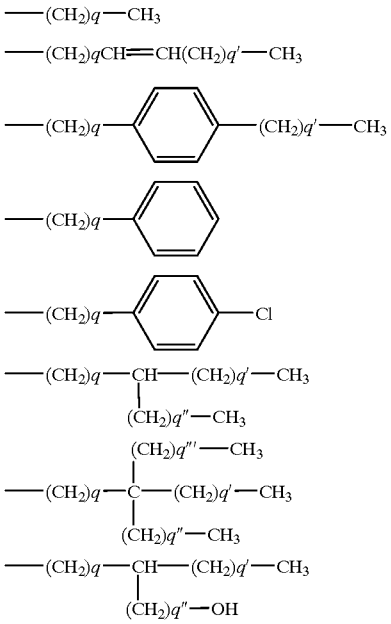

In the above, q, q', q", and q'" are each an integer that can satisfy the number of carbon atoms contained in the hydrocarbon group represented by $R^{11}$, $R^{12}$, and $R^{13}$.

It is preferable that $X^{11}$ (when j=0) and $X^{13}$ (when l=1) comprise at least one group selected from the following five groups:

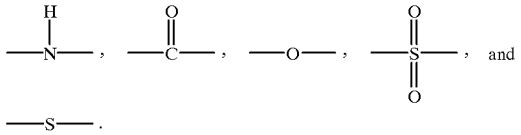

Specific examples of the above-mentioned monovalent group represented by $X^{11}$ and $X^{13}$ are as follows:

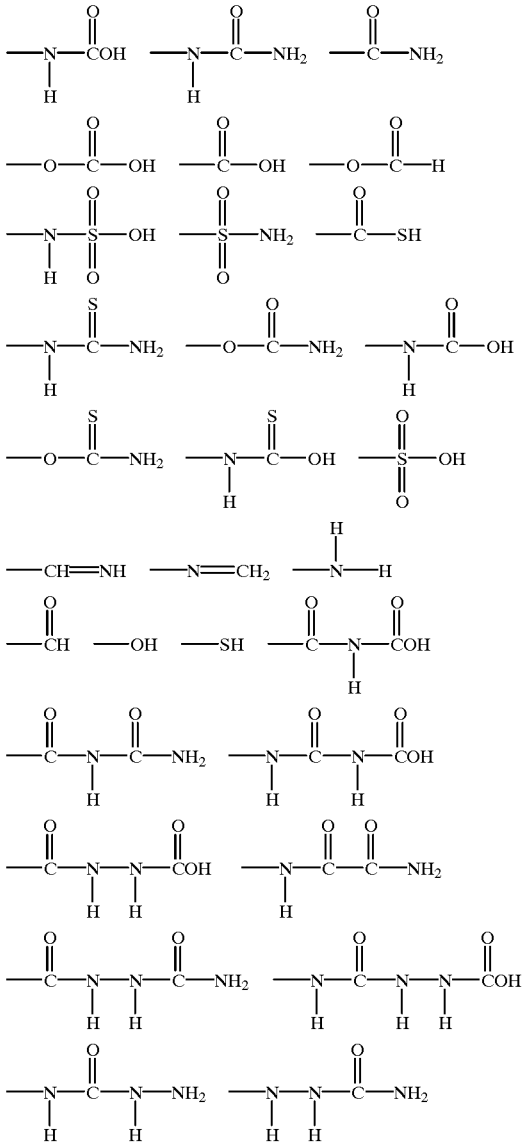

When $X^{12}$, and $X^{11}$ (when j=1) are each a bivalent hetero-atom-containing group, there can be preferably employed any bivalent groups that comprise at least one group selected from the following five groups:

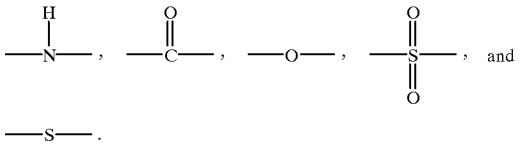

Specific examples of the bivalent hetero-atom-containing group represented by $X^{11}$ and $X^{12}$ are as follows:

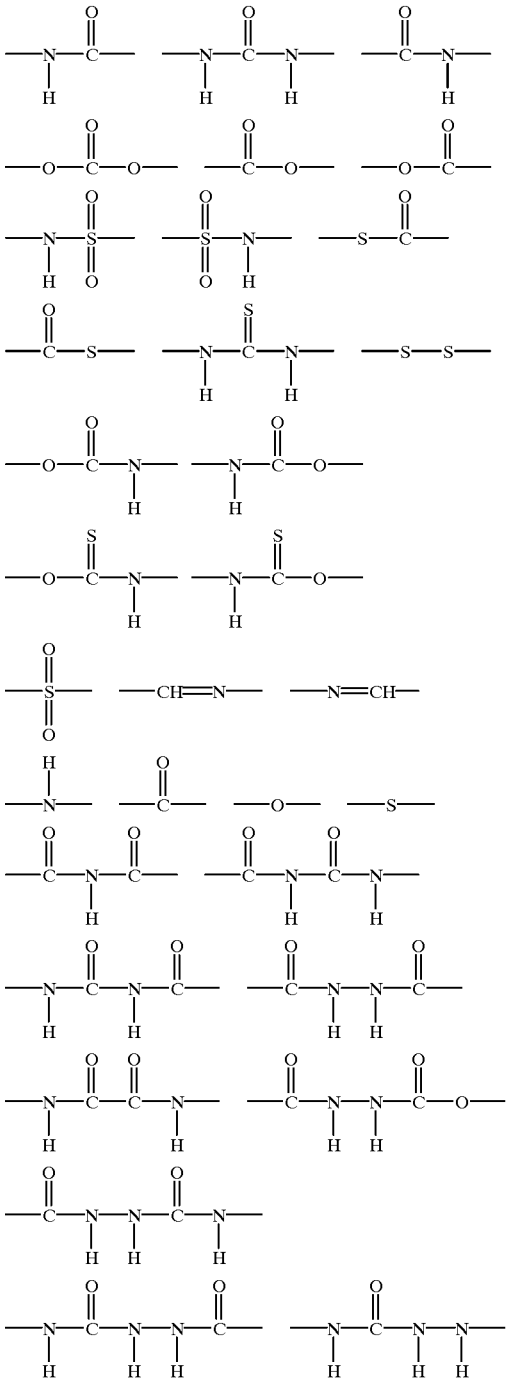

-continued

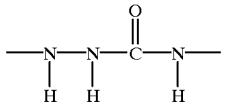

Of the above-mentioned compounds represented by formula (A), the following compounds of formulas (a), (b), and (c) are preferably employed as the color development and decolorization controlling agents.

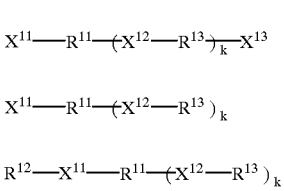

wherein $R^{11}$, $R^{12}$, $R^{13}$, $X^{11}$, $X^{12}$, and $X^{13}$ are the same as those previously defined; and k is an integer of 0 to 4, and when k is 2 or more, $R^{13}$ and $X^{12}$ may independently be the same or different.

Further, the following compounds of formulas (d), (e), (f), (g), (h), and (i) are more preferably employed:

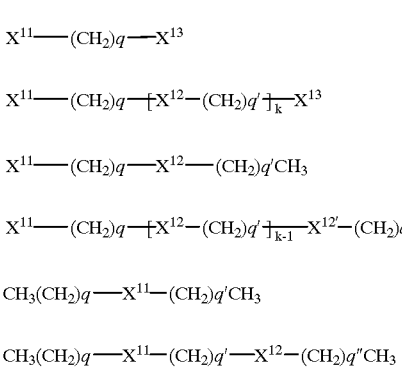

wherein $X^{11}$, $X^{12}$, $X^{13}$, and k are the same as those previously defined; q, q", and q'" are the same as those previously defined; and $X^{12'}$ is a group different from the group represented by $X^{12}$ when k is an integer of 2 to 4.

For instance, specific examples of the color development and decolorization controlling agent represented by the above-mentioned formula (h) are as follows:

$CH_3(CH_2)q—NHCONH—(CH_2)q'CH_3$ (h)-1

$CH_3(CH_2)q—NHCO—(CH_2)q'CH_3$ (h)-2

$CH_3(CH_2)q—NHCOCONH—(CH_2)q'CH_3$ (h)-3

$CH_3(CH_2)q—NHCONHNH—(CH_2)q'CH_3$ (h)-4

$CH_3(CH_2)q—NHSO_2NH—(CH_2)q'CH_3$ (h)-5

$CH_3(CH_2)q—NHCOO—(CH_2)q'CH_3$ (h)-6

Specific examples of the color development and decolorization controlling agent represented by formula (i) are as follows:

$CH_3(CH_2)q—NHCO—(CH_2)q'—NHCONH—(CH_2)q"CH_3$ (i)-1

$CH_3(CH_2)q—OCO—(CH_2)q—NHCONH—(CH_2)q'CH_3$ (i)-2

$CH_3(CH_2)q—O—(CH_2)q—NHCONH—(CH_2)q''CH_3$ (i)-3

$CH_3(CH_2)q—NHNHCO—(CH_2)q—NHCONH—(CH_2)q''CH_3$ (i)-4

$CH_3(CH_2)q—NHSO_2—(CH_2)q—NHCONH—(CH_2)q''CH_3$ (i)-5

$CH_3(CH_2)q—NCONH—(CH_2)q—NHCONH—(CH_2)q''CH_3$ (i)-6

$CH_3(CH_2)q—NHCOCONH—(CH_2)q—NHCONH—(CH_2)q''CH_3$ (i)-7

$CH_3(CH_2)q—NHCO—(CH_2)q—NHCO—(CH_2)q''CH_3$ (i)-8

$CH_3(CH_2)q—OCO—(CH_2)q—NHCO—(CH_2)q''CH_3$ (i)-9

$CH_3(CH_2)q—O—(CH_2)q—NHCO—(CH_2)q''CH_3$ (i)-10

$CH_3(CH_2)q—NHNHCO—(CH_2)q—NHCO—(CH_2)q''CH_3$ (i)-11

$CH_3(CH_2)q—NHSO_2—(CH_2)q—NHCO—(CH_2)q''CH_3$ (i)-12

$CH_3(CH_2)q—NHCONH—(CH_2)q'—NHCO—(CH_2)q''CH_3$ (i)-13

$CH_3(CH_2)q—NHCOCONH—(CH_2)q'—NHCO—(CH_2)q''CH_3$ (i)-14

$CH_3(CH_2)q—NHCO—(CH_2)q'—NHCO—(CH_2)q''CH_3$ (i)-15

$CH_3(CH_2)q—NHCO—(CH_2)q'—CONH—(CH_2)q''CH_3$ (i)-16

$CH_3(CH_2)q—NHCO—(CH_2)q'—NHCOCONH—(CH_2)q''CH_3$ (i)-17

$CH_3(CH_2)q—NHCO—(CH_2)q'—NHCONHNH—(CH_2)q''CH_3$ (i)-18

$CH_3(CH_2)q—NHCO—(CH_2)q'—NHCONH—(CH_2)q''CH_3$ (i)-19

Furthermore, specific examples of the compound represented by formula (h)-1 are as follows:

$CH_3(CH_2)_{17}—NHCONH—CH_3$ $CH_3(CH_2)_{17}—NHCONH—(CH_2)_2CH_3$ $CH_3(CH_2)_{17}—NHCONH—(CH_2)_3CH_3$ $CH_3(CH_2)1_7—NHCONH—(CH_2)_4CH_3$ $CH_3(CH_2)_{17}—NHCONH—(CH_2)_5CH_3$ $CH_3(CH_2)_{17}—NHCONH—(CH_2)_6CH_3$ $CH_3(CH_2)_{17}—NHCONH—(CH_2)_7CH_3$ $CH_3(CH_2)_{17}—NHCONH—(CH_2)_8CH_3$ $CH_3(CH_2)_{17}—NHCONH—(CH_2)_9CH_3$ $CH_3(CH_2)_{17}—NHCONH—(CH_2)_{10}CH_3$ $CH_3(CH_2)_{17}—NHCONH—(CH_2)_{11}CH_3$ $CH_3(CH_2)_{17}—NHCONH—(CH_2)_{15}CH_3$ $CH_3(CH_2)_{17}—NHCONH—(CH_2)_{17}CH_3$ $CH_3(CH_2)_{17}—NHCONH—(CH_2)_{21}CH_3$ $CH_3(CH_2)_{15}—NHCONH—(CH_2)_4CH_3$ $CH_3(CH_2)_{21}i—NHCONH—(CH_2)_2CH_3$ $CH_3(CH_2)_{21}—NHCONH—(CH_2)_3CH_3$ $CH_3(CH_2)_{21}—NHCONH—(CH_2)_4CH_3$ $CH_3(CH_2)_{21}—NHCONH—(CH_2)_{17}CH_3$

Specific examples of the compound represented by formula (i)-6 are as follows:

$CH_3(CH_2)_{17}—NHCONH—(CH_2)_{12}—NHCONH—(CH_2)_{17}CH_3$ $CH_3(CH_2)_{17}—NHCONH—(CH_2)_6—NHCONH—(CH_2)_{17}CH_3$ $CH_3(CH_2)_{17}—NHCONH—(CH_2)_2—NHCONH—(CH_2)_{17}$ $CH_3(CH_2)_{21}—NHCONH—(CH_2)_6—NHCONH—(CH_2)_{21}CH_3$ $CH_3(CH_2)_{21}—NHCONH—(CH_2)_{12}—NHCONH—(CH_2)_{21}CH_3$ $CH_3(CH_2)_{21}—NHCONH—(CH_2)_6—NHCONH—(CH_2)_{21}CH_3$ $CH_3(CH_2)_2i—NHCONH—(CH_2)_3—NHCONH—(CH_2)_{21}CH_3$ $CH_3—NHCONH—(CH_2)_{12}—NHCONH—CH_3$ $CH_3(CH_2)_2—NHCONH—(CH_2)_{18}—NHCONH—(CH_2)_2CH_3$ $CH_3—NHCONH—(CH_2)_6—NHCONH—(CH_2)_{17}CH_3$ $CH_3(CH_2)_5—NHCONH—(CH_2)_6—NHCONH—(CH_2)_5CH_3$ $CH_3(CH_2)_5—NHCONH—(CH_2)_{12}—NHCONH—(CH_2)_5CH_3$

In the reversible thermosensitive recording medium, the recording layer is found to be most seriously damaged by the repeated color development and decolorization operations, namely, repeated image formation and erasure. The improvement in the heat resistance of the recording layer can enhance the repeated use durability of the obtained recording medium as a whole.

When the recording layer comprises a cross-linked resin, the heat resistance of the recording layer can be improved, and the repeated use durability of the reversible thermosensitive recording medium according to the present invention can be improved. Such durability of the recording medium can be further enhanced by providing on the recording layer a protective layer which is similarly made of a cross-linked resin.

Such a cross-linked resin can be obtained by selecting the combination of a cross-linking agent and a resin comprising an active group that is reactive with the above-mentioned cross-linking agent. The resin can be cured by cross-linking under application of heat thereto.

As the resin usable for the cross-linking, there can be employed various resins having hydroxyl group or carboxyl group that is reactive with the cross-linking agent, for example, phenoxy resin, poly(vinyl butyral) resin, cellulose acetate propionate, and cellulose acetate butyrate. Further, there can be employed copolymer resins comprising a monomer with hydroxyl group or carboxyl group. Examples of such copolymer resins are vinyl chloride-vinyl acetate-vinyl alcohol copolymer, vinyl chloride-vinyl acetate-hydroxypropyl acrylate copolymer, and vinyl chloride-vinyl acetate-maleic anhydride copolymer.

Isocyanate compounds, amino compounds, phenol compounds, amine compounds, and epoxy compounds can be used as the cross-linking agents for thermal cross-linking. With respect to the isocyanate compounds, isocyanate compounds having a plurality of isocyanate groups, for example, hexamethylene diisocyanate (HDI), toluene diisocyanate (TDI), xylylene diisocyanate (XDI), and isophorone diisocyanate (IPDI) can be employed. Further, an adduct of the above-mentioned isocyanate compound with trimethylolpropane, an isocyanate compound having a biuret structure, an isocyanurate compound, and a blocked isocyanate compound are also usable.

When the cross-linking agent is added to the resin, it is preferable that the ratio of the number of functional groups contained in the cross-linking agent to the number of active groups contained in the resin be in the range of 0.01 to 1. When the resin is cross-linked by the addition of a cross-linking agent in such an amount, the strength of the cross-linked resin is sufficient in terms of the heat resistance. Further, the addition of the cross-linking agent has no adverse effect on the color development and decolorization properties.

As a cross-linking accelerating agent, any catalyst conventionally used in the above-mentioned cross-linking reaction may be used. For example, a tertiary amine compound such as 1,4-diaza-bicyclo[2,2,2]octane, and a metal compound such as an organic tin compound are used as the cross-linking accelerating agents.

The resin may be subjected to not only heat application, but also ultraviolet light irradiation or electron beam irradiation.

The following monomers can be used for ultraviolet light irradiation and electron beam irradiation.

Specific examples of monofunctional monomers are methyl methacrylate, ethyl methacrylate, n-butyl methacrylate, i-butyl methacrylate, t-butyl methacrylate, 2-ethylhexyl methacrylate, lauryl methacrylate, tridecyl methacrylate, stearyl methacrylate, cyclohexyl methacrylate, benzyl methacrylate, methacrylic acid, 2-hydroxyethyl methacrylate, 2-hydroxypropyl methacrylate, dimethylaminoethyl methacrylate, diethylaminoethyl methacrylate, glycidyl methacrylate, tetrahydrofurfuryl methacrylate, allyl methacrylate, ethylene glycol dimethacrylate, triethylene glycol dimethacrylate, tetraethylene glycol dimethacrylate, 1,3-butylene glycol dimethacrylate, 1,6-hexanediol dimethacrylate, trimethylolpropane trimethacrylate, 2-ethoxyethyl methacrylate, 2-ethylhexyl acrylate, 2-ethoxyethyl acrylate, 2-ethoxyethoxyethyl acrylate, 2-hydroxyethyl acrylate, 2-hydroxypropyl acrylate, dicyclopentenylethyl acrylate, N-vinyl pyrrolidone, and vinyl acetate.

Specific examples of bifunctional monomers are as follows: 1,4-butanediol diacrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, bisphenol A ethylene oxide adduct diacrylate, glycerin methacrylate acrylate, diacrylate with 2-mole adduct of propylene oxide of neopentyl glycol, diethylene glycol diacrylate, polyethylene glycol (400) diacrylate, diacrylate of the ester of hydroxypivalic acid and neopentyl glycol, 2,2-bis(4-acryloxydiethoxy-phenyl) propane, diacrylate of neopentyl glycol diadipate, diacrylate of ϵ-caprolactone adduct of neopentyl glycol hydroxypivalate, 2-(2-hydroxy-1,1-dimethylethyl)-5-hydroxymethyl-5-ethyl-1,3-dioxanediacrylate, tricyclodecanedimethylol diacrylate, ϵ-caprolactone adduct of tricyclodecanedimethylol diacrylate, and diacrylate of glycidyl ether of 1,6-hexanediol.

Specific examples of the polyfunctional monomers are as follows: trimethylolpropane triacrylate, glycerine propylene oxide adduct acrylate, trisacryloyloxyethyl phosphate, pentaerythritol acrylate, triacrylate with 3-mole adduct of propylene oxide of trimethylolpropane, dipentaerythritol polyacrylate, polyacrylate of caprolactone adduct of dipentaerythritol, propionic acid dipentaerythritol triacrylate, hydroxypivalaldehyde-modified dimethylolpropine triacrylate, tetraacrylate of dipentaerythritol propionate, ditrimethylolpropane tetraacrylate, pentaacrylate of dipentaerythritol propionate, dipentaerythritol hexaacrylate, and ϵ-caprolactone adduct of dipentaerythritol hexaacrylate.

One example of the oligomer is bisphenol A-diepoxyacrylic acid adduct.

When the cross-linking reaction is carried out by ultraviolet light irradiation, the following photopolymerization initiators and photopolymerization promoters are used.

Specific examples of the photopolymerization initiators for use in the present invention include benzoin ethers such as isobutyl benzoin ether, isopropyl benzoin ether, benzoin ethyl ether, and benzoin methyl ether; α-acyloxym esters such as 1-phenyl-1,2-propanedione-2-(o-ethoxycarbonyl) oxym; benzylketals such as 2,2-dimethoxy-2-phenylacetophenone, and benzyl hydroxycyclohexylphenolketone; acetophenone derivatives such as diethoxyacetophenone and 2-hydroxy-2-methyl-1-phenylpropane-1-one; and ketones such as benzophenone, chlorothioxanthone, 2-chlorothioxanthone, isopropyl thioxanthone, 2-methyl thioxanthone, and 2-chlorobenzophenone.

Those photopolymerization initiators can be used alone or in combination. It is preferable to employ such a photopolymerization initiator in an amount of 0.005 to 1.0 part by weight, more preferably 0.01 to 0.5 parts by weight, to one part by weight of any of the previously mentioned cross-linking agents.

As the photopolymerization promotor, there are an aromatic tertiary amine compound and an aliphatic amine compound. Specific examples of the photopolymerization promoters include isoamyl p-dimethylaminobenzoate and ethyl p-dimetylaminobenzoate.

These photopolymerization promoters can be used alone or in combination. It is preferable to employ such a photopolymerization promotor in an amount of 0.1 to 5 parts by weight, more preferably in an amount of 0.3 to 3 parts by weight, to one part by weight of a photopolymerization initiator.

As the light source for ultraviolet light irradiation apparatus, a mercury lamp, a metal halide lamp, a gallium lamp, a mercury xenon lamp, or a flashlamp may be employed. However, any light source can be employed as long as it has a light emitting spectrum corresponding to the ultraviolet absorption wavelength for the previously mentioned photopolymerization initiators and photopolymerization promoters. As to the conditions for ultraviolet light irradiation, the lamp output and transportation speed may be determined in accordance with the irradiation energy necessary for cross-linking the resin.

Generally, electron beam (EB) irradiation apparatus can be classified into a scan beam EB irradiation apparatus and an area beam EB irradiation apparatus. An appropriate EB irradiation apparatus may be chosen in accordance with the desired irradiation area, exposure and other factors. The current, radiation width, and transportation speed may be determined in consideration of the exposure necessary for cross-linking the employed resin.

In the present invention, the reversible thermosensitive coloring composition comprises an electron-accepting compound, namely, a color developer. As the color developer, a phenol compound represented by the following formula (B) is preferably used to improve the image contrast.

(B)

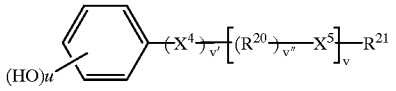

wherein v' is an integer of 0 or 1, and when v'=1, $X^4$ is a bivalent hetero-atom-containing group; $X^5$ is a bivalent hetero-atom-containing group; v" is an integer of 1 or 0, and when v"=1, $R^{20}$ is a bivalent hydrocarbon group; $R^{21}$ is a hydrocarbon group having 1 to 22 carbon atoms; v is an integer of 0 to 4, and when v" is 1 and v is 2 to 4, $R^{20}$ and $X^5$ are each independently the same or different; and u is an integer of 1 to 3.

To be more specific, $R^{20}$ and $R^{21}$ are each a hydrocarbon group. which may have a substituent such as hydroxyl group, a halogen atom, or an alkoxyl group. An aliphatic or aromatic hydrocarbon group is usable, and the hydrocarbon group may comprise an aliphatic hydrocarbon group and an aromatic hydrocarbon group in combination. The aliphatic hydrocarbon group may be a straight-chain one or a branched one, and contain an unsaturated bond therein.

In the compound of formula (B), it is preferable that the total number of carbon atoms included in $R^{20}$ and $R^{21}$ be 8 or more, and more preferably 11 or more in light of the stability of color development, and the improvement of decolorization properties.

When v" is 1, preferable examples of the bivalent hydrocarbon group represented by $R^{20}$ are as follows:

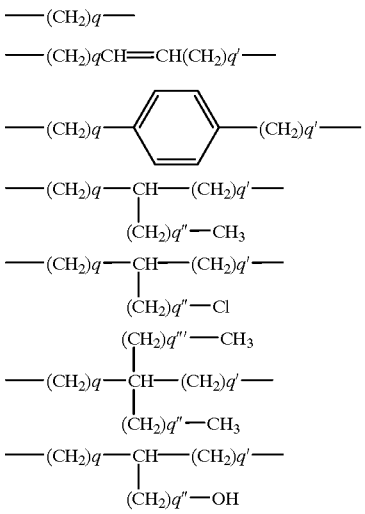

Preferable examples of the hydrocarbon group represented by $R^{21}$ are as follows:

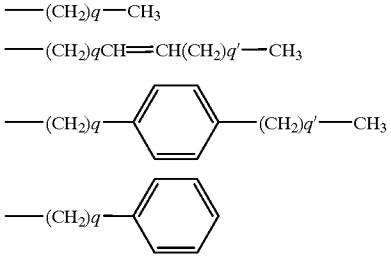

-continued

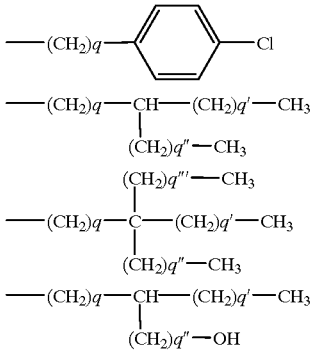

wherein q, q', q", and q'" are each independently such an integer that satisfies the total number of carbon atoms of $R^{20}$ or $R^{21}$.

When $X^4$ and $X^5$ are each a bivalent hetero-atom-containing group, there can be preferably employed any bivalent groups that have at least one group selected from the following five groups:

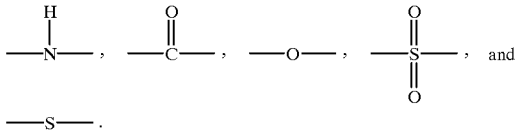

Specific examples of the bivalent hetero-atom-containing group represented by $X^4$ and $X^5$ are as follows:

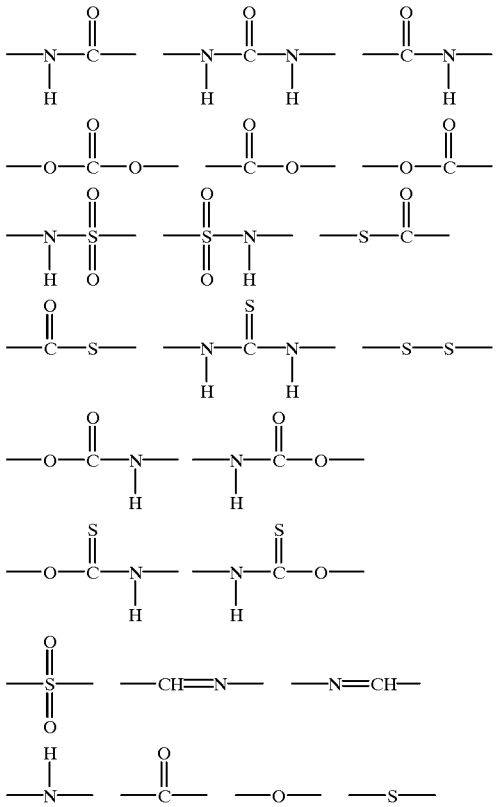

-continued

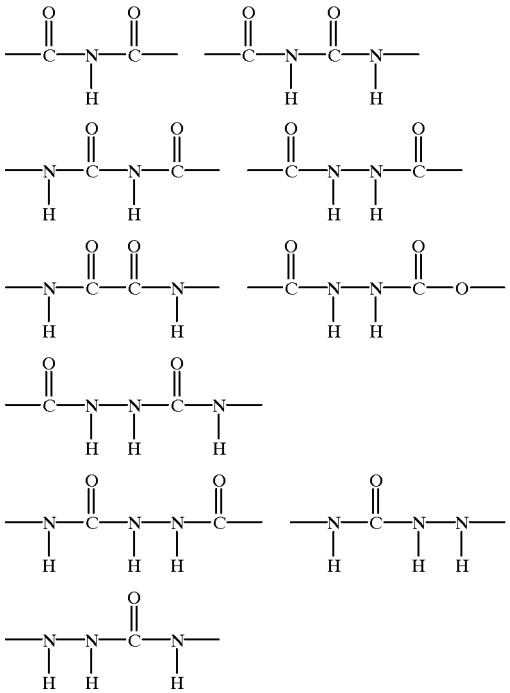

Of the above-mentioned phenol compounds represented by formula (B), the following specific compounds of formulas (B)-1 to (B)-8 are preferably employed as the color developers in the present invention.

(B)-1

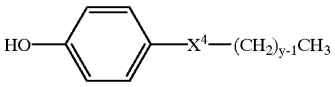

(B)-2

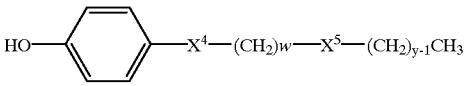

(B)-3

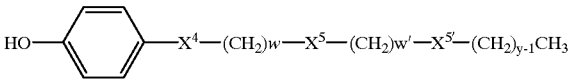

(B)-4

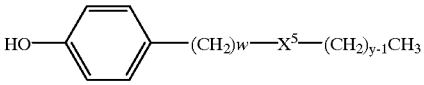

(B)-5

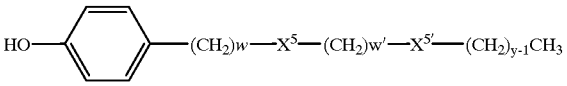

(B)-6

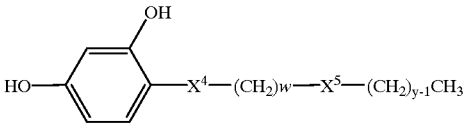

-continued (B)-7

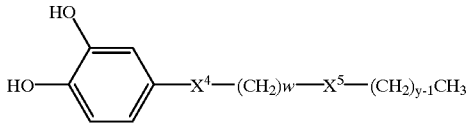

(B)-8

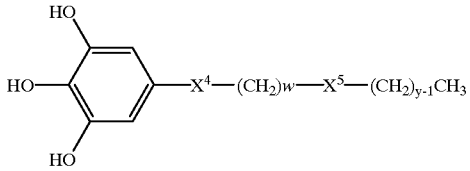

wherein w, w', and y are each independently such an integer that satisfies the total number of carbon atoms of $R^{20}$ or $R^{21}$.

Specific examples of the phenol compounds represented by formula (B)-2 are shown below.

(B)-2-(a)

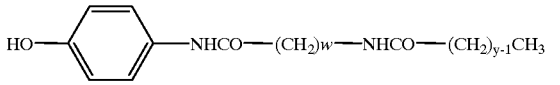

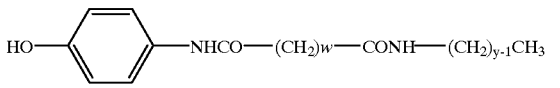

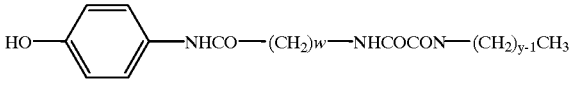

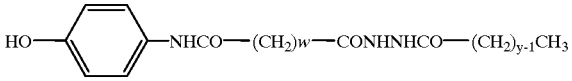

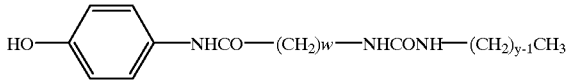

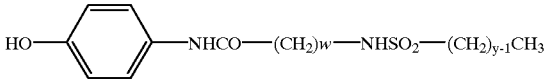

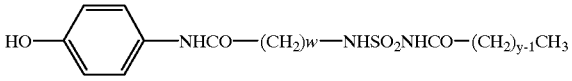

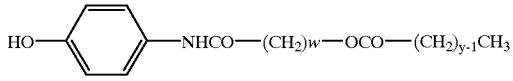

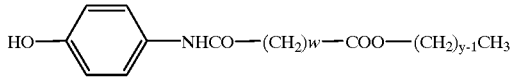

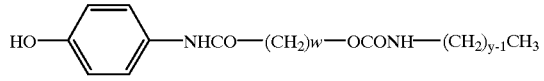

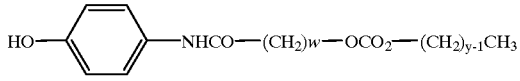

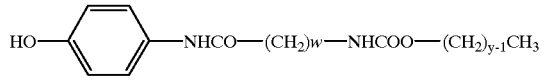

-continued

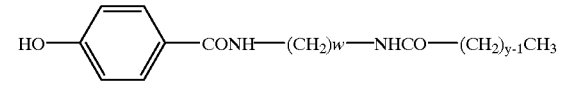

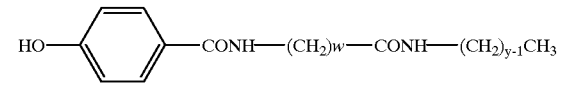

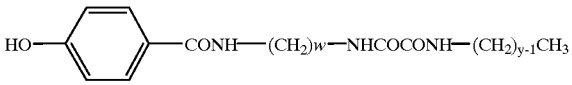

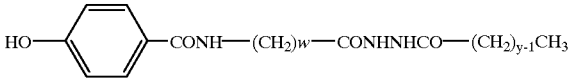

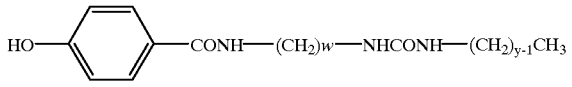

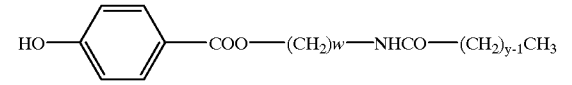

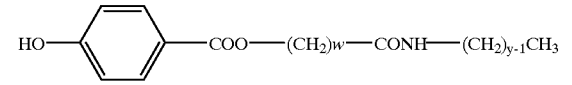

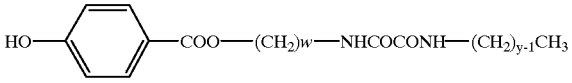

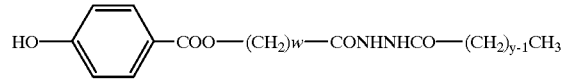

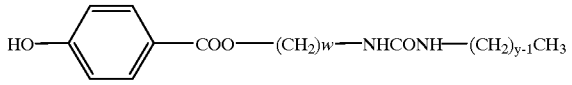

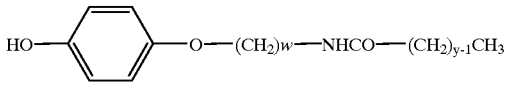

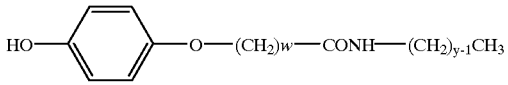

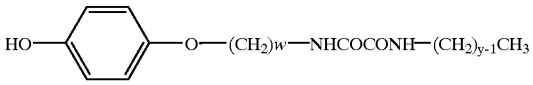

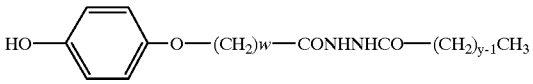

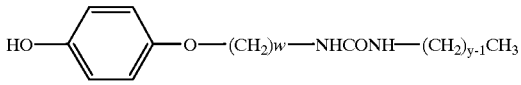

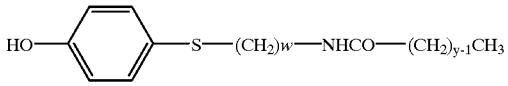

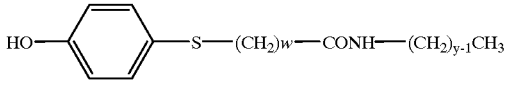

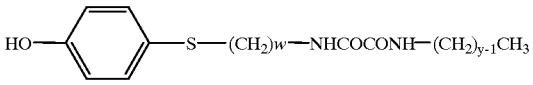

-continued

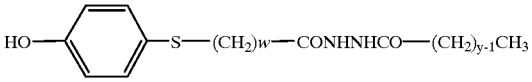

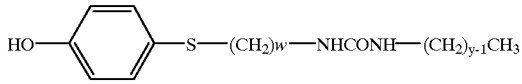

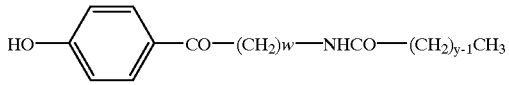

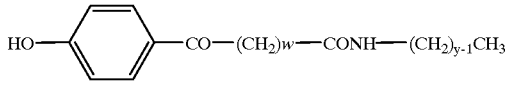

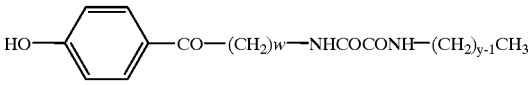

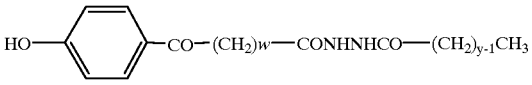

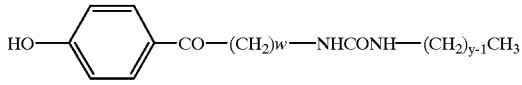

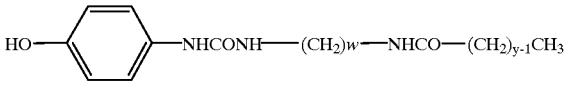

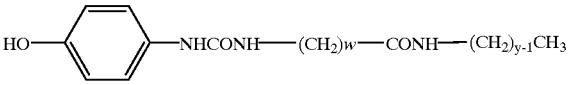

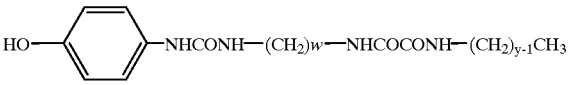

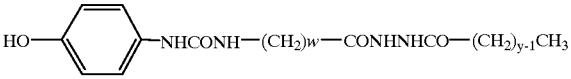

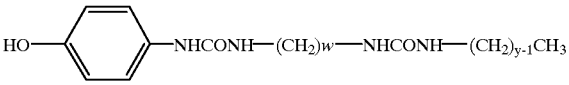

Examples of the phenol compounds represented by formulas (B)-1, and (B)-3 through (B)-8 can be similarly listed, but the phenol compounds for use in the present invention are not limited to those examples.

Taking as an example of the compound of formula (B)-2-(a) in the above, specific compounds represented by formula (B)-2-(a) that can be used as the color developers for use in the present invention are as follows:

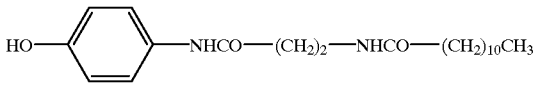

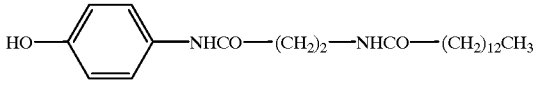

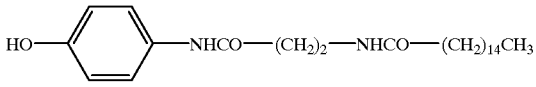

-continued

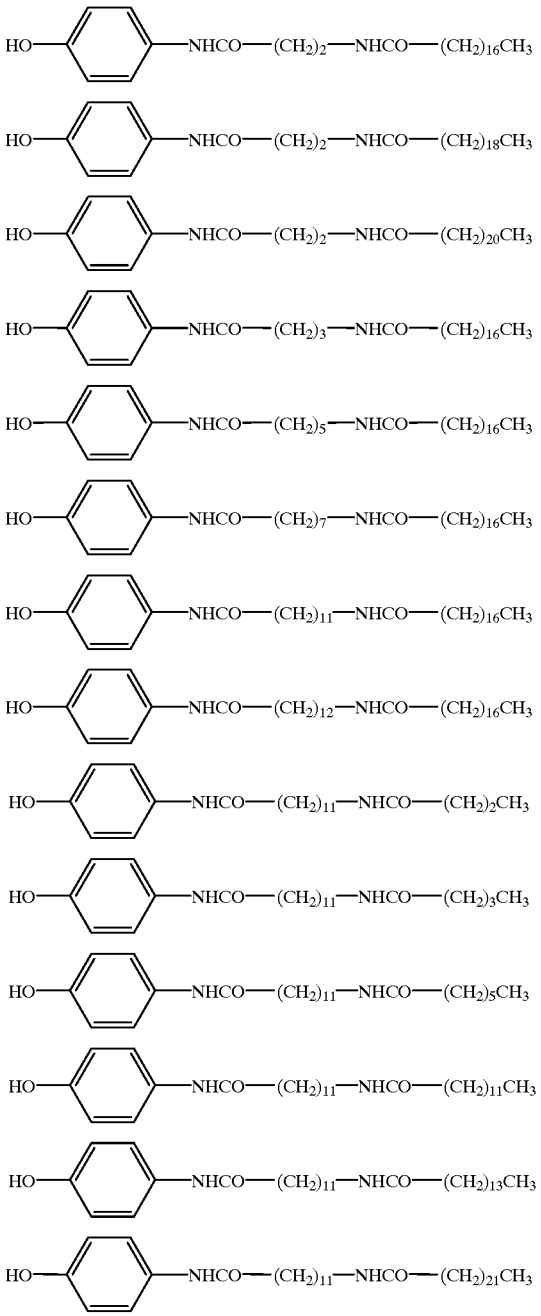

As previously mentioned, the protective layer comprising a cross-linked resin may be overlaid on the recording layer. In this case, the thermosetting resins, ultraviolet-curing resins, and electron radiation curing resins are also usable. The head-matching properties and the repeated use durability of the recording medium can be further improved by providing the above-mentioned protective layer. The protective layer may further comprise various additives such as an ultraviolet absorber, an inorganic and/or organic filler, and a lubricant.

The color developer for use in the reversible thermosensitive coloring composition for use in the present invention may comprise other conventional color developers together with the above-mentioned phenol compound of formula (B). As such conventional color developers, there can be employed any compounds that are provided with not only a molecular structure having a capability of inducing color formation in the coloring agent, but also a molecular structure for controlling the cohesion between the molecules thereof. For example, an organic phosphoric acid compound, an aliphatic carboxylic acid compound, and a phenol compound, each having a long-chain hydrocarbon group, are used as the color developers as disclosed in Japanese Laid-Open Patent Application 5-124360.

Specific examples of the organic phosphoric acid compound serving as the color developer for use in the present invention are as follows: dodecylphosphonic acid, tetradecylphosphonic acid, hexadecylphosphonic acid, octadecylphosphonic acid, eicosylphosphonic acid, dococylphosphonic acid, tetracosylphosphonic acid, ditetradecylphosphate ester, dihexadecylphosphate ester, dioctadecylphosphate ester, dieicosylphosphate ester, and dibehenyl phosphate ester.

Specific examples of the aliphatic carboxylic acids are as follows: 2-hydroxytetradecanoic acid, 2-hydroxyhexadecanoic acid, 2-hydroxyoctadecanoic acid, 2-hydroxyeicosanic acid, 2-hydroxydocosanoic acid, 2-bromohexadecanoic acid, 2-bromooctadecanoic acid, 2-bromoeicosanic acid, 2-bromodocosanoic acid, 3-bromooctadecanoic acid, 3-bromodocosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanic acid, 2-fluorodocosanoic acid, 2-iodohexadecanoic acid, 2-iodooctadecanoic acid, 3-iodohexadecanoic acid, 3-iodooctadecanoic acid, and perfluorooctadecanoic acid.

Examples of the aliphatic dicarboxylic acids and tricarboxylic acids are as follows: 2-dodecyloxysuccinic acid, 2-tetradecyloxysuccinic acid, 2-hexadecyloxysuccinic acid, 2-octadecyloxysuccinic acid, 2-eicosyloxysuccinic acid, 2-dodecyloxysuccinic acid, 2-dodecylthiosuccinic acid, 2-tetradecylthiosuccinic acid, 2-hexadecylthiosuccinic acid, 2-octadecylthiosuccinic acid, 2-eicosylthiosuccinic acid, 2-docosylthiosuccinic acid, 2-tetracosylthiosuccinic acid, 2-hexadecyldithiosuccinic acid, 2-octadecyldithiosuccinic acid, 2-eicosyldithiosuccinic acid, dodecylsuccinic acid, tetradecylsuccinic acid, pentadecylsuccinic acid, hexadecylsuccinic acid, octadecylsuccinic acid, eicosylsuccinic acid, docosylsuccinic acid, 2,3-dihexadecylsuccinic acid, 2,3-dioctadecylsuccinic acid, 2-methyl-3-hexadecylsuccinic acid, 2-methyl-3-octadecylsuccinic acid, 2-octadecyl-3-hexadecylsuccinic acid, hexadecylmalonic acid, octadecylmalonic acid, eicosylmalonic acid, docosylmalonic acid, dihexadecylmalonic acid, dioctadecylmalonic acid, didocosylmalonic acid, methyloctadecylmalonic acid, 2-hexadecylglutaric acid, 2-octadecylglutaric acid, 2-eicosylglutaric acid, docosylglutaric acid, 2-pentadecyladipic acid, 2-octadecyladipic acid, 2-eicosyladipic acid, 2-docosyladipic acid, 2-hexadecanoyloxypropane- 1,2,3-tricarboxylic acid, and 2-octadecanoyloxypropane-1,2,3-tricarboxylic acid.

As the coloring agent for use in the reversible thermosensitive coloring composition, the conventional leuco dyes can freely be employed. In particular, the following compounds of formulas (C) to (E) are preferably used alone or in combination as the coloring agent.

(C)

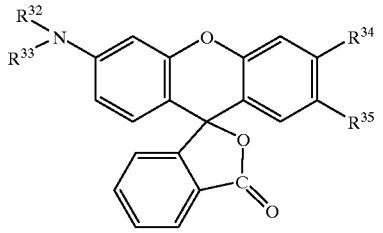

wherein $R^{32}$ and $R^{33}$ are each a lower alkyl group, an aryl group which may have a substituent, or a hydrogen atom, and $R^{32}$ and $R^{33}$ may form a ring in combination; $R^{34}$ is a lower alkyl group, a halogen atom, or a hydrogen atom; and $R^{35}$ is a lower alkyl group, a halogen atom, a hydrogen atom, or a substituted anilino group of the following formula:

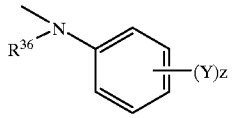

in which $R^{36}$ is a lower alkyl group or a hydrogen atom; Y is a lower alkyl group or a halogen atom; and z is an integer of 0 to 3.

(D)

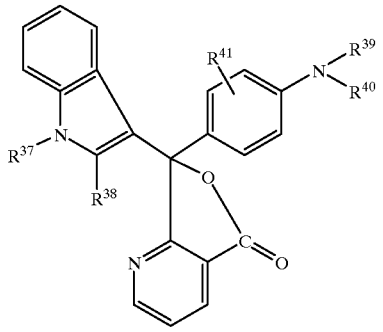

wherein $R^{37}$ to $R^{40}$ are each an alkyl group or a hydrogen atom; and $R^{41}$ is an alkyl group, an alkoxyl group, or a hydrogen atom.

(E)

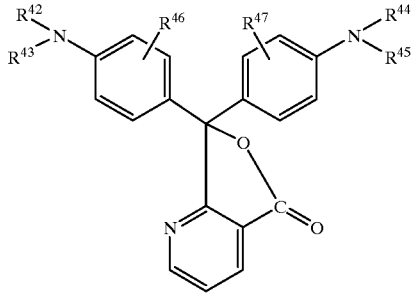

wherein $R^{42}$ to $R^{45}$ are each a lower alkyl group or a hydrogen atom; and $R^{46}$ and $R^{47}$ are each an alkyl group, an alkoxyl group, or a hydrogen atom.

Specific examples of the leuco dyes serving as the coloring agents are as follows:

2-anilino-3-methyl-6-diethylaminofluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6- (N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino) fluoran,
2-(N-ethyl-p-toluidino)-3-methyl-6-(N-propyl-p-toluidino) fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran,
2,2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide, and
3,3-bis(2-ethoxy-4-diethylaminophenyl)-7-azaphthalide.

In addition to the above-mentioned fluoran compounds and azaphthalide compounds, the following conventional leuco dyes may be used alone or in combination.

2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibutylaminofluoran,
1,2-benzo-6-(N-methyl-N-cyclohexylamino)fluoran, and
1,2-benzo-6-(N-ethyl-N-toluidino)fluoran.

In addition to the above, the following coloring agents can also be employed in the present invention:

2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino)fluoran,
2-(α-phenylethylamino)-4-methyl-6-diethylaminofluoran,
2-(p-toluidino)-3-(t-butyl)-6-(N-methyl-p-toluidino)fluoran,
2-(o-methoxycarbonylamino)-6-diethylaminofluoran,
2-acetylamino-6-(N-methyl-p-toluidino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino) fluoran,
2-mesidino-4',5'-benzo-6-diethylaminofluoran,
2-(m-trifluoromethylanilino)-3-methyl-6-pyrrolidino-fluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenyl-methylamino)-6-pyrrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran,
benzo leuco methylene blue,
2-[3,6-bis(diethylamino)-7-(o-chloroanilino)xanthyl] benzoic acid lactam,
2-[3,6-bis(diethylamino)-9-(o-chloroanilino)xanthyl] benzoic acid lactam,
3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl) phthalide,
3-(2-methoxy-4-dimethylaminophenyl)-3-(2-hydroxy-4,5-dichlorophenyl) phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-4-chloro-5-methoxyphenyl)phthalide,
3,6-bis(dimethylamino)fluorenespiro (9,3')-6'-dimethylaminophthalide,
6'-chloro-8'-methoxy-benzoindolino-spiropyran, and
6'-bromo-2'-methoxy-benzoindolino-spiropyran.

The reversible thermosensitive recording layer for use in the present invention can reversibly assume a color-developed state and a decolorized state by controlling the temperature of the coloring composition contained in the recording layer in the heating step and/or controlling the cooling rate in the cooling step after the heating step. The color development and decolorization phenomenon of the reversible thermosensitive coloring composition for use in the present invention will now be explained with reference to FIG. 1.

In FIG. 1, the abscissa axis of the graph indicates the temperature of a reversible thermosensitive coloring composition, and the ordinate axis indicates the color-developed density of the reversible thermosensitive coloring composition. As is apparent from the graph, the color-developed density of the reversible thermosensitive coloring composition for use in the present invention changes depending on the temperature thereof.

In FIG. 1, reference symbol A shows a decolorized state of the reversible thermosensitive coloring composition at room temperature. When the temperature of the coloring composition in the decolorized state A is raised and reaches a temperature $T_1$, the color development takes place because the coloring composition begins to fuse at the temperature $T_1$. Thus, reference symbol B shows a color-developed state of the composition in a fused condition.

When the temperature of the fused composition in the color-developed state B is rapidly decreased to room temperature, the color-developed state is maintained as a color-developed state C, passing along the route indicated by the solid line between B and C. Reference symbol C shows the color-developed state of the composition in a solid form at room temperature. It depends on the descending rate of temperature in the cooling step whether the color-developed state of the coloring composition can be maintained at room temperature or not. If the fused coloring composition in the color-developed state B is gradually cooled, decolorization takes place while the temperature is descending, passing along the route indicated by the dotted line between B and A. As a result, the coloring composition returns to the initial decolorized state A, or the color-developed density of the composition becomes relatively lower than that of the composition in the color-developed state C.

When the composition in the color-developed state C, which is obtained from the color-developed state B by rapid cooling, is heated again, decolorization takes place at a temperature $T_2$, that is lower than the color development temperature $T_1$, and the color-developed density of the composition is decreased, passing along the route indicated by the broken line between D and E. Thereafter, by decreasing the temperature of the composition, the composition is returned to the initial decolorized state A.

The color development temperature and the decolorization temperature vary depending on the color developer and coloring agent employed for the reversible thermosensitive coloring composition, so that the color developer and the coloring agent may be selected according to the application of the reversible thermosensitive coloring composition. In addition, the color-developed density of the composition in the color-developed state B is not always the same as that of the composition in the color-developed state C.

In the color-developed state C of the reversible thermosensitive coloring composition, which is obtained at room temperature by rapidly cooling the fused composition in the color-developed state B, the color developer and the coloring agent are mixed to such a degree that the molecules of the color developer and the coloring agent are in contact with each other to induce the coloring reaction. In such a color-developed state C, the color developer and the coloring agent form an aggregation structure on a molecular level to maintain the color development phenomenon. It is considered that the color-developed state can be maintained in a stable condition at room temperature owing to the formation of the above-mentioned aggregation structure.

On the other hand, the molecules of the color developer and those of the coloring agent cause the phase separation in the decolorized state. In such a decolorized state, the molecules of at least one component, the color developer or the coloring agent, are independently gathered to form a domain or caused to crystallize out. The molecules of the coloring agent can be separated from those of the color developer by the formation of a domain or crystallization, so that the decolorized state can be stabilized. According to the present invention, in many cases, the completely decolorized state can be obtained by the phase separation of the color developer from the coloring agent, and the crystallization of the color developer.

As shown in FIG. 1, the decolorization takes place when the fused composition in the color-developed state B is gradually cooled, or when the solid composition in the color-developed state C is heated to the temperature $T_2$. In both cases, the aggregation structure of the molecules of the color developer and the coloring agent is broken, and at the same time, the phase separation is induced and the color developer crystallizes out in the composition at the decolorization temperature.

In the reversible thermosensitive recording medium of the present invention, a colored recording image can be formed in the recording layer in such a manner that the recording medium is heated to fuse the coloring composition, for example, by using a thermal head, and then rapidly cooled. To erase the colored recording image, the recording medium is once heated and thereafter gradually cooled. Alternatively, the recording medium in the color-developed state is heated to a temperature ($T_2$) which is lower than the color development temperature ($T_1$) The above-mentioned two methods for erasing the colored recording image are the same in the sense that the recording medium is temporarily retained at a temperature where the molecules of the color developer and those of the coloring agent cause phase separation or at least one of the color developer or the coloring agent is caused to crystallize.

In the color development process, the recording medium is once heated to the color development temperature, and then rapidly cooled. Such a rapid cooling step is necessary to prevent the reversible thermosensitive recording medium from being retained at the temperature of phase separation or crystallization.

To achieve the rapid or gradual cooling operation in the color development and decolorization process, the temperature-descending rate may be relatively determined according to the combination of the color developer and the coloring agent for use in the reversible thermosensitive coloring composition.

The mixing ratio of the coloring agent to the color developer in the reversible thermosensitive coloring composition varies depending on the combination of compounds to be employed. In most cases, it is preferable that the molar ratio of the color developer to the coloring agent be in the range of 0.1 to 20, more preferably 0.2 to 10. When the ratio of the coloring developer to the coloring agent is within the above-mentioned range, the image density of a colored state is sufficient.

Further in the recording layer, it is preferable that the amount ratio by weight of the previously mentioned decolorization accelerating agent or color development and decolorization controlling agent be in the range of 0.1 to 300 wt. %, and more preferably in the range of 3 to 100 wt. %, of the total weight of the color developer.

The coloring agent, the color developer, and the decolorization accelerating agent for use in the recording layer may be enclosed in microcapsules, optionally with the addition thereto of the color development and decolorization controlling agent.

Furthermore, in the reversible thermosensitive recording layer, it is preferable that the amount ratio by weight of a coloring component concerned in color development and decolorization, that is, the coloring agent, the color developer, and the decolorization accelerating agent, with the color development and decolorization controlling agent being optionally added thereto, to the binder resin be in the range of (0.1:1) to (10:1). In such a case, the heat resistance of the recording layer is sufficiently increased, and the color-developed density can be inhibited from decreasing.

To provide the reversible thermosensitive recording layer on a support, the coating liquid for the recording layer may be prepared by uniformly mixing and dispersing the previously mentioned color developer, coloring agent, decolorization accelerating agent, color development and decolorization controlling agent, binder resin, and a proper solvent.

Specific examples of the solvent used for the preparation of the coating liquid for the recording layer include water; alcohols such as methanol, ethanol, isopropanol, n-butanol, and methylisocarbinol; ketones such as acetone, 2-butanone, ethyl amyl ketone, diacetone alcohol, isophorone, and cyclohexanone; amides such as N,N-dimethylformamide and N,N-dimethylacetoamide; ethers such as diethyl ether, isopropyl ether, tetrahydrofuran, 1,4-dioxane, and 3,4-dihydro-2H-pyran; glycol ethers such as 2-methoxyethanol, 2-ethoxyethanol, 2-butoxyethanol, and ethylene glycol dimethyl ether; glycol ether acetates such as 2-methoxyethyl acetate, 2-ethoxyethyl acetate, and 2-butoxyethyl acetate; esters such as methyl acetate, ethyl acetate, isobutyl acetate, amyl acetate, ethyl lactate, and ethylene carbonate; aromatic hydrocarbons such as benzene, toluene, and xylene; aliphatic hydrocarbons such as hexane, heptane, iso-octane, and cyclohexane; halogenated hydrocarbons such as methylene chloride, 1,2-dichloroethane, dichloropropane, and chlorobenzene; sulfoxides such as dimethyl sulfoxide; and pyrrolidones such as N-methyl-2-pyrrolidone and N-octyl-2-pyrrolidone.

For the preparation of the coating liquid, there can be employed various conventional dispersion mixers such as a paint shaker, ball mill, attritor, three-roll mill, keddy mill, sand mill, and colloid mill.

The above-mentioned components may be dispersed in the solvent using the mixer. Alternatively, each component may be dispersed in a solvent, followed by mixing the dispersions.

The coating method for providing the recording layer is not particularly limited, and conventional coating methods such as blade coating, wire-bar coating, spray coating, air-knife coating, beads coating, curtain coating, gravure coating, kiss-roll coating, reverse-roll coating, dip coating, and die coating are usable.

After the coating liquid for recording layer is applied to the support, the coating liquid is dried, and cured when necessary. When the binder resin which is cross-linkable by the application of heat is used to provide the recording layer, the coating liquid may be subjected to heat treatment in a temperature-controlled bath. For example, the heat treatment may be carried out at a relatively high temperature for a short period of time, or a relatively low temperature for a long period of time. In the case where the ultraviolet curing resin or electron beam curing resin is used for the recording layer, the conventional apparatus for curing each resin may be employed. As the light source for ultraviolet light irradiation apparatus, a mercury lamp, a metal halide lamp, a gallium lamp, a mercury xenon lamp, or a flashlamp may be employed. Any light source can be employed as long as it has a light emitting spectrum corresponding to the ultraviolet absorption wavelength for the previously mentioned photopolymerization initiators and photopolymerization promotors. As to the conditions for ultraviolet light irradiation, the lamp output and transportation speed may be determined in accordance with the irradiation energy necessary for cross-linking the resin. With respect to the electron beam (EB) irradiation apparatus, the scan beam or area beam EB irradiation apparatus may be chosen in accordance with the desired irradiation area, exposure, and other factors. The current, radiation width, and transportation speed may be determined in accordance with the exposure necessary for cross-linking the resin.

It is preferable that the thickness of the reversible thermosensitive recording layer be in the range of 1 to 20 $\mu$m, more preferably in the range of 3 to 10 $\mu$m.

Any material can be used for the support of the reversible thermosensitive recording medium so long as it can support the recording layer thereon. For example, a sheet of paper, a resin film, a synthetic paper, a metallic foil, a glass plate, and a composite member of the above-mentioned materials can be employed.

In the reversible thermosensitive recording medium of the present invention, a variety of additives may be employed when necessary in order to improve and control the coating characteristics of the recording layer and the color development and decolorization properties. Examples of the additives are a surfactant, an electroconductivity imparting agent, a filler, an antioxidant, a light stabilizer, and an agent for stabilizing color development.

As previously mentioned, it is preferable to successively provide the recording layer and the protective layer on the support, each layer comprising the cross-linked resin. Furthermore, an adhesive layer or undercoat layer may be interposed between the support and the recording layer, and an intermediate layer may be interposed between the recording layer and the protective layer. In addition, a backcoat layer may be provided on the back surface of the support, opposite to the recording layer side with respect to the support.

Each of the above-mentioned layers and the support may be colored with a coloring material. Namely, the surface of the recording medium may be partially or entirely colored by printing. On the top surface of the reversible thermosensitive recording medium, there may be provided a printing layer comprising a resin as the main component.

The protective layer may comprise conventional resins other than the previously mentioned cross-linked resin. For example, poly(vinyl alcohol), styrene-maleic anhydride copolymer, carboxy-modified polystyrene, melamine-formaldehyde resin, and urea-formaldehyde resin are usable for formation of the protective layer.

It is preferable that the protective layer have a thickness of 0.1 to 20 $\mu$m, more preferably 0.3 to 10 $\mu$m.

The intermediate layer may be provided between the recording layer and the protective layer for the following purposes: improving the adhesion between both layers, inhibiting changes in the characteristics of the recording layer caused by the application of a coating liquid for protective layer thereon, and preventing the additives contained in the protective layer from penetrating into the recording layer.

The undercoat layer with heat insulating properties may be provided between the support and the recording layer to efficiently utilize the thermal energy applied to the recording medium. In this case, the undercoat layer can be formed on the support by coating a mixture of a binder resin and organic or inorganic minute void particles on the support. The undercoat layer may be provided in order to improve the adhesion of the recording layer to the support and prevent the components for use in the recording layer from permeating through the support.

The same resins as employed in the formation of the recording layer can be used for the formation of the intermediate layer and the undercoat layer.

The above-mentioned undercoat layer, recording layer, intermediate layer, and protective layer may further comprise a filler.

The filler for use in the present invention is classified into an inorganic filler and an organic filler.

Specific examples of the inorganic filler include carbonates such as calcium carbonate and magnesium carbonate; silicates such as silicic anhydride, hydrous silicic acid, hydrous aluminum silicate, and hydrous calcium silicate; metallic oxides such as zinc oxide, indium oxide, alumina, silica, zirconium oxide, tin oxide, cerium oxide, iron oxide, antimony oxide, barium oxide, calcium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate, and potassium titanate; metallic sulfides and sulfuric-acid-containing compounds such as zinc sulfide and barium sulfate; metallic carbides such as titanium carbide, silicon carbide, molybdenum carbide, tungsten carbide, and tantalum carbide; and metallic nitrides such as aluminum nitride, silicon nitride, boron nitride, zirconium nitride, vanadium nitride, titanium nitride, niobium nitride, and gallium nitride.

Examples of the organic filler for use in the present invention are silicone resin, cellulose resin, epoxy resin, nylon resin, phenolic resin, polyurethane resin, urea resin, melamine resin, polyester resin, polycarbonate resin, styrene resins such as styrene, polystyrene, poly(styrene-isoprene), and styrene vinyl benzene, acrylic resins such as vinylidene chloride-acryl resin, acryl-urethane resin, and ethylene-acryl resin, polyethylene resin, formaldehyde resins such as benzoguanamine-formaldehyde and melamine-formaldehyde, poly(methyl methacrylate) resin, and vinyl chloride resin.

In the present invention, the organic filler may be used alone or in combination, and the composite organic filler may be used. The organic filler for use in the present invention is in the form of a sphere, plate, or needle.

It is preferable that the amount ratio by volume of filler in each layer be in the range of 1 to 95 vol. %, and more preferably 5 to 75 vol .%.

Each of the undercoat layer, the recording layer, the intermediate layer, and the protective layer may further comprise a lubricant. Specific examples of the lubricant for use in the present invention include synthetic waxes such as ester wax, paraffin wax, and polyethylene wax; vegetable waxes such as hardened castor oil; animal waxes such as tallow; higher alcohols such as stearyl alcohol and behenyl alcohol; higher fatty acids such as margaric acid, lauric acid, myristic acid, palmitic acid, stearic acid, and behenic acid; higher fatty acid esters such as fatty acid ester of sorbitan; and amides such as stearamide, oleamide, lauramide, ethylene bisstearamide, methylene bisstearamide, and methylol stearamide.

It is preferable that the amount ratio by volume of lubricant in each layer be in the range of 0.1 to 95 vol. %, and more preferably 1 to 75 vol. %.

In the reversible thermosensitive recording medium of the present invention, the intermediate layer and the protective layer may further comprise an inorganic or organic ultraviolet absorbing agent. In this case, it is preferable that the amount ratio by weight of the ultraviolet absorbing agent be in the range of 0.5 to 10 parts by weight with respect to 100 parts by weight of the binder resin for use in the layer.

Specific examples of the ultraviolet absorbing agent for use in the present invention are as follows:

(1) benzotriazole ultraviolet light absorbers such as 2-(2'-hydroxy-5'-methylphenyl)benzotriazole, 2-(2'-hydroxy-5'-t-butylphenyl)benzotriazole, 2-(2'-hydroxy-3',5'-di-t-butylphenyl)benzotriazole, 2-(2'-hydroxy-3'-t-butyl-5'-methylphenyl)benzotriazole, 2-(2'-hydroxy-5'-octoxyphenyl)benzotriazole, 2-(2'-hydroxy-3',5'-di-t-butylphenyl)-5-chlorobenzotriazole, 2-(2'-hydroxy-3'-t-butyl-5'-methylphenyl)-5-chlorobenzotriazole, and 2-(2'-hydroxy-5'-ethoxyphenyl)benzotriazole;

(2) benzophenone ultraviolet light absorbers such as 2,4-dihydroxybenzophenone, 2-hydroxy-4-methoxybenzophenone, 2-hydroxy-4-n-octoxybenzophenone, 2-hydroxy-4-dodecyloxybenzophenone, 2,2'-dihydroxy-4-methoxybenzophenone, 2,2'-dihydroxy-4,4'-dimethoxybenzophenone, 2,2',4,4'-tetrahydroxybenzophenone, 2-hydroxy-4-methoxy-2'-carboxybenzophenone, 2-hydroxy-4-oxybenzylbenzophenone, 2-hydroxy-4-chlorobenzophenone, 2-hydroxy-4-methoxybenzophenone-5-sulfonic acid, sodium 2-hydroxy-4-methoxybenzophenone-5-sulfonate, and sodium 2,2'-dihydroxy-4,4'-dimethoxybenzophenone-sulfonate;

(3) salicylic ester ultraviolet light absorbers such as phenyl salicylate, p-octylphenyl salicylate, p-t-butylphenyl salicylate, carboxyphenyl salicylate, methylphenyl salicylate, dodecylphenyl salicylate, 2-ethylhexylphenyl salicylate, and homomenthylphenyl salicylate;

(4) cyano acrylate ultraviolet light absorbers such as 2-ethylhexyl-2-cyano-3,3'-diphenyl acrylate, and ethyl-2-cyano-3,3'-diphenyl acrylate;

(5) p-aminobenzoic acid ultraviolet light absorbers such as p-aminobenzoic acid, glyceryl p-aminobenzoate, amyl p-dimethylaminobenzoate, and ethyl p-dihydroxypropylbenzoate;

(6) cinnamic acid ultraviolet light absorbers such as p-methoxycinnamic acid-2-ethylhexyl, and p-methoxycinnamic acid-2-ethoxyethyl; and (7) others such as 4-t-butyl-4'-methoxydibenzoylmethane, urocanic acid, and ethyl urocanate.

The intermediate layer and the protective layer can be provided by the conventional coating, drying and curing methods using the same solvent and the same dispersion apparatus as used for the formation of the recording layer.

To obtain a colored recording image in the reversible thermosensitive recording medium of the present invention, the recording medium may be once heated to a temperature higher than the color development temperature, and thereafter rapidly cooled. More specifically, the recording layer of the recording medium may be heated imagewise for a short period of time using a thermal head or by the application of laser beam thereto. In such a case, the recording layer is just partially heated, so that heat diffusion takes place immediately after the completion of heating step. Therefore, the recording medium can be rapidly cooled. Thus, a color-developed state can be maintained in a stable condition.

To erase the colored recording image formed in the reversible thermosensitive recording medium, the recording medium may be heated for a relatively long period of time, followed by gradual cooling, using an appropriate heat source. When the recording medium is heated for a relatively long period of time, the temperature of the recording medium is necessarily increased in a large area. Therefore, the temperature-descending rate becomes relatively slow in the cooling step, so that the decolorization takes place in the process of gradual cooling. In this case, a heat roller, heat stamp, or heated air may be used as the heating means, or the colored image may be heated for a long period of time by use of the thermal head.

Alternatively, the colored recording image can be erased from the recording medium by temporarily heating the recording medium to a specific temperature lower than the color development temperature. In this case, the thermal head is preferably employed as the heating means. To erase the colored recording image, the thermal energy applied to the recording medium by the thermal head may be relatively lowered by controlling the applied voltage, pulse number, pulse width, and pulse spacing as compared with the applied thermal energy in the image recording process. According to this method, the recording and erasing operations can be carried out and the overwriting operation can be achieved by use of the identical thermal head. As a matter of course, the heat roller and the heat stamp can also be employed in such a case.

For achieving image formation and erasure, the reversible thermosensitive recording medium of the present invention may be used with not only a thermal printer, but also a thermal transfer printer and a sublimation type printer.

Furthermore, the reversible thermosensitive recording medium of the present invention can be used as an image display medium. More specifically, information output from computer can be displayed on the recording medium using a printer equipped with a heating means for causing the color development in the recording medium. In other words, a hard copy can be obtained using the reversible thermosensitive recording medium of the present invention. The information displayed on the recording medium can be erased therefrom by using a heating means capable of causing the decolorization in the recording medium. Therefore, the image display medium can be used many times.

Further, using a printer provided with the heating means for image erasure and image formation, newly output information can be recorded in the recording medium with the previous information being erased therefrom.

In addition, overwriting operation can be carried out in such a manner that a thermal energy capable of at least erasing the colored image formed in the recording medium is entirely applied to the recording medium, and a thermal energy for causing the color development is imagewise applied to the recording medium for the next recording. The information can be thus overwritten with no difficulty. The reversible thermosensitive recording medium can be used as a rewritable paper, so that it is possible to reduce the amount of consumed paper which has been increasing in recent years, and the recording medium of the present invention can be considered to be effective for environmental protection.

In the reversible thermosensitive recording medium of the present invention, the reversible thermosensitive recording layer is provided on the support. The support, which may be a laminated material, has a thickness of several micrometers to several millimeters. The recording medium of the present invention may further comprise a magnetic recording layer. In this case, the magnetic recording layer and the reversible thermosensitive recording layer may be arranged side by side on the same surface of the support. In addition, the magnetic recording layer may be interposed between the support and the reversible thermosensitive recording layer, or provided on the rear surface of the support, opposite to the reversible thermosensitive recording layer side with respect to the support.

Furthermore, the reversible thermosensitive recording medium of the present invention may be attached to another medium via an adhesive layer.

The recording medium may be prepared into a sheet or card. The shape of the recording medium may be freely determined. The surface of the recording medium may be subjected to printing. Namely, a printed image may be formed on the surface of the recording medium. The card-shaped recording medium needs a relatively thick support. To prepare such a card-shaped recording medium, a reversible thermosensitive recording layer is once provided on a thin support member, and another support member with a proper thickness may be attached to the thin support member. Alternatively, a reversible thermosensitive recording layer may be directly provided on a relatively thick support.

In addition, a non-reversible thermosensitive recording layer may be provided together with the previously mentioned reversible thermosensitive recording layer. In this case, the color tone of a colored recording image may be the same or different.

The reversible thermosensitive recording medium of the present invention can be used as a display medium of an image display apparatus.

Figure 2:
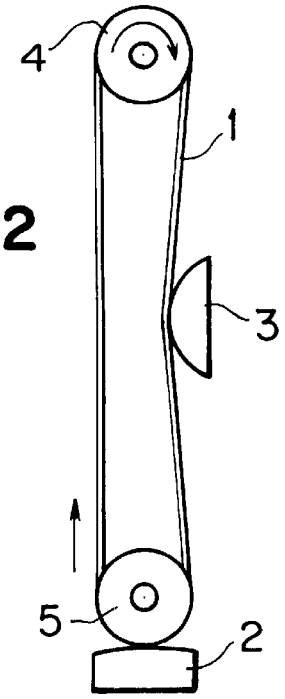
FIG. 2 is a schematic diagram of an image display apparatus employing a reversible thermosensitive recording medium of the present invention as a display medium.

FIG. 2 is a schematic diagram showing one example of an image display apparatus using a display medium of the present invention.

In FIG. 2, reference numeral 1 indicates a display medium 1 in the form of an endless belt comprising the reversible thermosensitive recording medium of the present invention; reference numeral 2, a thermal head for applying heat to a display region of the display medium 1 in order to form images in the display region; reference numeral 3, a thermal head for selectively applying heat to the display region or entirely applying heat to the display medium 1 to erase the images formed thereon; and reference numerals 4 and 5, a pair of rollers for rotating the display medium 1.

In this example, images are formed in the display medium 1 by use of the thermal head 2 and erased therefrom by use of the thermal head 3 as the display medium 1 is rotated in the direction of the arrow. Thus, the recording of information, and the erasure thereof, which are the most basic operations of this apparatus, are performed at independently different positions, and the display operation is performed by the periodical rotation of the recording medium. Such a simple mechanism can construct an image display apparatus with a large display region.

Furthermore, the reversible thermosensitive recording medium of the present invention can be used as a display medium for a projector type image display apparatus.

The reversible thermosensitive recording medium of the present invention is characterized in that the reversible thermosensitive recording layer comprises a specific decolorization accelerating agent. With respect to the constituents other than the decolorization accelerating agent for use in the recording layer, the additional layers, the application of the recording medium, and the specific method for realizing the above-mentioned application, Japanese Laid-Open Patent Application 5-124360 is applicable to the present invention.

Other features of this invention will become apparent in the course of the following description of exemplary embodiments, which are given for illustration of the invention and are not intended to be limiting thereof.

EXAMPLE 1

[Formation of Reversible Thermosensitive Recording Layer]

The following components were pulverized and dispersed using a ball mill to have an average particle size of 0.1 to 3 $\mu$m.

| | Parts by Weight |
|---|---|
| 2-anilino-3-methyl-6-dibutyl-aminofluoran | 2 |
| Color developer with the following structure: | 8 |

-continued

| | Parts by Weight |
|---|---|
| 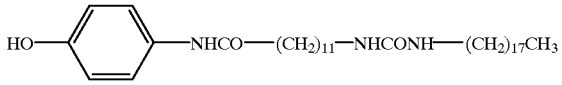 | |
| Decolorization accelerating agent with the following structure: | 3 |
| 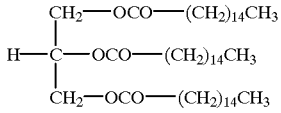 | |
| 15% tetrahydrofuran solution of acrylpolyol resin | 70 |

To the above prepared dispersion, 10 parts by weight of a 75% ethyl acetate solution of adduct type hexamethylene diisocyanate (Trademark "Coronate HL" made by Nippon Polyurethane Industry Co., Ltd.) were added, and the resultant mixture was thoroughly stirred to prepare a coating liquid for recording layer.

The recording layer coating liquid thus prepared was coated on the surface of a 188-$\mu$m-thick polyester film using a wire bar, and dried at 100° C. for 2 minutes, and thereafter at 60° C. for 24 hours, so that a reversible thermosensitive recording layer with a thickness of about 8.0 $\mu$m was provided on the support.

Thus, a reversible thermosensitive recording medium No. 1 according to the present invention was obtained.

EXAMPLE 2

The procedure for preparation of the reversible thermosensitive recording medium No. 1 in Example 1 was repeated except that the decolorization accelerating agent for use in the recording layer coating liquid in Example 1 was replaced by a decolorization accelerating agent represented by the following formula:

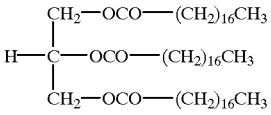

Thus, a reversible thermosensitive recording medium No. 2 according to the present invention was obtained.

EXAMPLE 3

The procedure for preparation of the reversible thermosensitive recording medium No. 1 in Example 1 was repeated except that the color developer and the decolorization accelerating agent for use in the recording layer coating liquid in Example 1 were replaced by the following color developer and decolorization accelerating agent.

[Color developer]

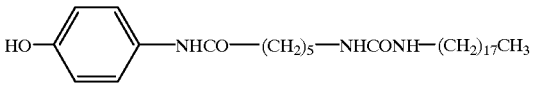

-continued

[Decolorization accelerating agent]

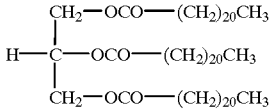

Thus, a reversible thermosensitive recording medium No. 3 according to the present invention was obtained.

EXAMPLE 4

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

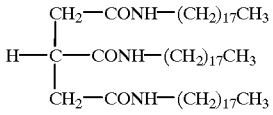

Thus, a reversible thermosensitive recording medium No. 4 according to the present invention was obtained.

EXAMPLE 5

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

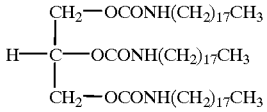

Thus, a reversible thermosensitive recording medium No. 5 according to the present invention was obtained.

EXAMPLE 6

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

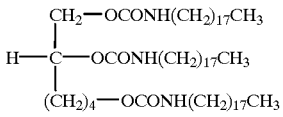

Thus, a reversible thermosensitive recording medium No. 6 according to the present invention was obtained.

EXAMPLE 7

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

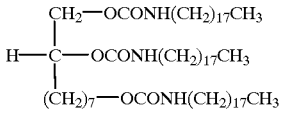

Thus, a reversible thermosensitive recording medium No. 7 according to the present invention was obtained.

EXAMPLE 8

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

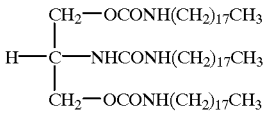

Thus, a reversible thermosensitive recording medium No. 8 according to the present invention was obtained.

EXAMPLE 9

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

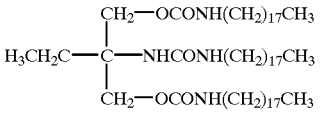

Thus, a reversible thermosensitive recording medium No. 9 according to the present invention was obtained.

EXAMPLE 10

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

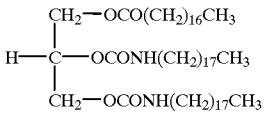

Thus, a reversible thermosensitive recording medium No. 10 according to the present invention was obtained.

EXAMPLE 11

The procedure for preparation of the reversible thermosensitive recording medium No. 3 in Example 3 was repeated except that the decolorization accelerating agent for use in the recording layer coating liquid in Example 3 was replaced by a decolorization accelerating agent represented by the following formula:

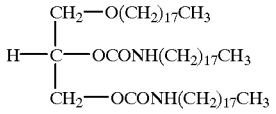

Thus, a reversible thermosensitive recording medium No. 11 according to the present invention was obtained.

EXAMPLE 12

The procedure for preparation of the reversible thermosensitive recording medium No. 1 in Example 1 was repeated except that the formulation for the reversible thermosensitive recording layer coating liquid used in Example 1 was replaced by the following formulation:

| | Parts by Weight |
|---|---|
| 2-anilino-3-methyl-6-dibutyl-aminofluoran | 2 |
| Color developer with the following structure: | 8 |
| 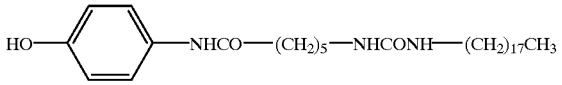 | |
| Decolorization accelerating agent with the following structure: | 1 |
| 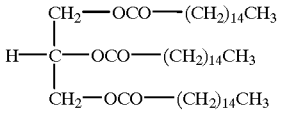 | |
| Color development and decolorization controlling agent with the following structure: $CH_3(CH_2)_4$—NHCONH—$(CH_2)_{17}CH_3$ | 3 |
| 15% tetrahydrofuran solution of acrylpolyol resin | 70 |

Thus, a reversible thermosensitive recording medium No. 12 according to the present invention was obtained.

EXAMPLE 13

The procedure for preparation of the reversible thermosensitive recording medium No. 12 in Example 12 was repeated except that the decolorization accelerating agent for use in the recording layer coating liquid in Example 12 was replaced by a decolorization accelerating agent represented by the following formula:

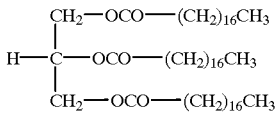

Thus, a reversible thermosensitive recording medium No. 13 according to the present invention was obtained.

EXAMPLE 14

The procedure for preparation of the reversible thermosensitive recording medium No. 12 in Example 12 was repeated except that the decolorization accelerating agent for use in the recording layer coating liquid in Example 12 was replaced by a decolorization accelerating agent represented by the following formula:

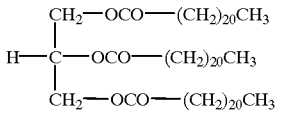

Thus, a reversible thermosensitive recording medium No. 14 according to the present invention was obtained.

EXAMPLE 15

The procedure for preparation of the reversible thermosensitive recording medium No. 12 in Example 12 was repeated except that the decolorization accelerating agent for use in the recording layer coating liquid in Example 12 was replaced by a decolorization accelerating agent represented by the following formula:

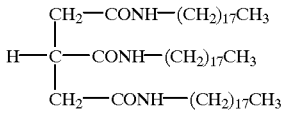

Thus, a reversible thermosensitive recording medium No. 15 according to the present invention was obtained.

Comparative Example 1

The procedure for preparation of the reversible thermosensitive recording medium No. 1 in Example 1 was repeated except that the decolorization accelerating agent for use in the recording layer coating liquid in Example 1 was removed from the formulation therefor and the color developer for use in the recording layer coating liquid in Example 1 was replaced by a color developer represented by the following formula:

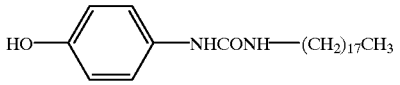

Thus, a comparative reversible thermosensitive recording medium No. 1 was obtained.

Comparative Example 2

The procedure for preparation of the reversible thermosensitive recording medium No. 1 in Example 1 was repeated except that the decolorization accelerating agent for use in the recording layer coating liquid in Example 1 was replaced by a compound represented by the following formula:

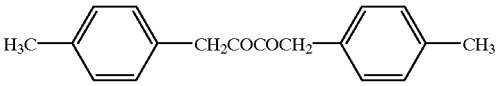

Thus, a comparative reversible thermosensitive recording medium No. 2 was obtained.

Each of the reversible thermosensitive recording media No. 1 to No. 15 according to the present invention fabricated in Examples 1 to 15 and the comparative reversible thermosensitive recording media No.1 and No. 2 fabricated in Comparative Examples 1 and 2 was set in a commercially available thermal printer (made by Okura Electric Company) and subjected to a color development and decolorization test by the following method:

A colored image was formed in each reversible thermosensitive recording medium by thermal printing under the conditions that the applied voltage was 13.3 V and the pulse width was 1.2 msec. The color-developed density of the thus obtained colored image was measured using a Macbeth densitometer RD-914. The results are shown in TABLE 1.

Then, the colored image formed in each recording medium was erased therefrom by heating the recording medium at 110° C. for one second, using a commercially available heat gradient tester (made by Toyo Seiki Seisaku-Sho, Ltd.) The densities of the decolorized image portion and the background portion were measured in the same manner as mentioned above.

The decolorization properties were evaluated by subtracting the density of the background portion from the density of the decolorized image portion. The obtained value was referred to as a residual colored density. The results are shown in TABLE 1.

In addition, when the colored image was formed in each recording medium, the image density ($Di_1$) of the colored image portion and the density ($Db_1$) of the background portion were measured in the same manner as mentioned above. The thus obtained image-bearing sample was stored at 50° C. under dry condition for 24 hours. After the storage, the densities of the image portion ($Di_2$) and the background portion ($Db_2$) were measured. In accordance with the following formula, the color-developed density retaining ratio was obtained. The results are shown in TABLE 1.

TABLE 1

$$\text{Color-developed density retaining ratio (\%)} = \frac{(Di_2) - (Db_2)}{(Di_1) - (Db_1)} \times 100$$

| | Initial Color-developed Density | Residual Colored Density | Color-developed Density Retaining Ratio (%) |
|---|---|---|---|
| Ex. 1 | 0.93 | 0.02 | 89 |
| Ex. 2 | 0.96 | 0.02 | 87 |
| Ex. 3 | 0.95 | 0.02 | 86 |
| Ex. 4 | 0.97 | 0.02 | 91 |
| Ex. 5 | 1.01 | 0.02 | 91 |
| Ex. 6 | 0.98 | 0.02 | 90 |
| Ex. 7 | 0.98 | 0.02 | 88 |
| Ex. 8 | 1.00 | 0.03 | 91 |
| Ex. 9 | 1.01 | 0.03 | 90 |
| Ex. 10 | 0.97 | 0.02 | 87 |
| Ex. 11 | 0.98 | 0.02 | 88 |
| Ex. 12 | 1.03 | 0.01 | 94 |
| Ex. 13 | 1.05 | 0.01 | 96 |
| Ex. 14 | 1.13 | 0.01 | 99 |
| Ex. 15 | 1.12 | 0.01 | 98 |
| Comp. Ex. 1 | 1.00 | 0.12 | 30 |
| Comp. Ex. 2 | 1.03 | 0.08 | 60 |

EXAMPLE 16

[Formation of Reversible Thermosensitive Recording Layer]

The reversible thermosensitive recording layer was provided on the support in the same manner as in Example 14.

[Formation of Protective Layer]

The following components were thoroughly stirred and dissolved to prepare a coating liquid for protective layer.

| | Parts by Weight |
|---|---|
| Urethane acrylate ultraviolet curing resin (Trademark "C7-157" made by Dainippon Ink & Chemicals, Incorporated | 15 |
| Ethyl acetate | 85 |

The protective layer coating liquid thus prepared was coated on the reversible thermosensitive recording layer using a wire bar, and dried at 90° C. for one minute. Thereafter, the coated liquid was cured by being caused to pass through an ultraviolet lamp of 80 W/cm at a speed of 9 m/min. As a result, a protective layer with a thickness of 3 μm was provided on the reversible thermosensitive recording layer.

Thus, a reversible thermosensitive recording medium No. 16 according to the present invention was obtained.

EXAMPLE 17

[Formation of Reversible Thermosensitive Recording Layer]

The reversible thermosensitive recording layer was provided on the support in the same manner as in Example 15.

[Formation of Protective Layer]

The protective layer was provided on the reversible thermosensitive recording layer in the same manner as in Example 16.

Thus, a reversible thermosensitive recording medium No. 17 according to the present invention was obtained.

EXAMPLE 18

[Formation of Reversible Thermosensitive Recording Layer]

The following components were pulverized and dispersed using a ball mill to have an average particle size of 0.1 to 3 μm.

| | Parts by Weight |
|---|---|
| 2-anilino-3-methyl-6-dibutyl-aminofluoran | 2 |
| Color developer with the following structure: | 8 |

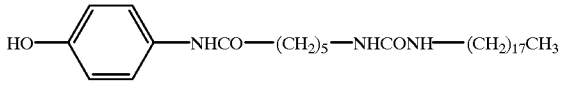

| | |
|---|---|
| Decolorization accelerating agent with the following structure: | 1 |

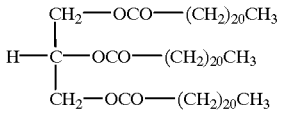

| | |
|---|---|
| 15% methyl ethyl ketone (MEK) solution of vinyl chloride-vinyl acetate resin (Trademark "VYHH" made by Union Carbide Japan K. K.) | 120 |

The resultant mixture was thoroughly stirred to prepare a coating liquid for recording layer.

The recording layer coating liquid thus prepared was coated on the surface of a 188-μm-thick polyester film using a wire bar, and dried at 100° C. for 2 minutes, so that a reversible thermosensitive recording layer with a thickness of about 8.0 μm was provided on the support.

[Formation of Protective Layer]

A methyl ethyl ketone solution of vinyl chloride-vinyl acetate resin (Trademark "VYHH", made by Union Carbide Japan K.K.) was coated on the above prepared recording layer using a wire bar, and dried at 100° C. for 3 minutes. A protective layer with a thickness of about 3 μm was provided on the reversible thermosensitive recording layer.

Thus, a reversible thermosensitive recording medium No. 18 according to the present invention was obtained.

Each of the reversible thermosensitive recording media No. 16 to No. 18 respectively fabricated in Examples 16 to 18 was subjected to a color development and decolorization test under the same conditions as mentioned above. Such a color development and decolorization test was repeated 50 times. After the test was repeated, the appearance of the surface of each recording medium was examined, and the color-developed density of a colored image portion was measured. In addition, the residual colored density as previously defined was obtained. The results are shown in TABLE 2.

TABLE 2

| | After Repetition of Color Development and Decolorization | | |
|---|---|---|---|
| | Color-developed density | Residual colored density | Bruise on the medium |
| Ex. 16 | 1.12 | 0.01 | none |
| Ex. 17 | 1.11 | 0.01 | none |
| Ex. 18 | 1.07 | 0.03 | observed |

EXAMPLE 19

[Formation of Reversible Thermosensitive Recording Layer]

The reversible thermosensitive recording layer was provided on the support in the same manner as in Example 14.

[Formation of Intermediate Layer]

The following components were mixed to prepare a coating liquid for intermediate layer:

| | Parts by Weight |
|---|---|
| 15% MEK solution of acryl polyol resin | 30 |
| (2-hydroxy-4-n-octoxy) benzophenone (Trademark "Viosorb 130" made by Kyodo Chemical Co., Ltd.) | 4 |
| Trademark "Coronate HL" made by Nippon Polyurethane Industry Co., Ltd. | 4 |

The intermediate layer coating liquid was coated on the recording layer using a wire bar, and dried at 100° C. for 2 minutes, and thereafter at 60° C. for 24 hours, so that an intermediate layer with a thickness of 2 μm was provided on the reversible thermosensitive recording layer.

[Formation of Protective Layer]

The protective layer was provided on the intermediate layer in the same manner as in Example 16.

Thus, a reversible thermosensitive recording medium No. 19 according to the present invention was obtained.

EXAMPLE 20

[Formation of Reversible Thermosensitive Recording Layer]

The reversible thermosensitive recording layer was provided on the support in the same manner as in Example 15.

[Formation of Intermediate Layer]

The intermediate layer was provided on the reversible thermosensitive recording layer in the same manner as in Example 19.

[Formation of Protective Layer]

The protective layer was provided on the intermediate layer in the same manner as in Example 16.

Thus, a reversible thermosensitive recording medium No. 20 according to the present invention was obtained.

A colored recording image was formed in each of the reversible thermosensitive recording media No. 19 and No. 20 respectively fabricated in Examples 19 and 20 under the same conditions as mentioned above. Thereafter, each recording medium was exposed to fluorescent lighting of 5000 lux for 100 hours. After light exposure, the colored image was erased in the same manner as mentioned above. As a result, a portion where a colored image had been formed did not deteriorate after light exposure, and the colored image was completely erased from that portion.

As previously explained, the reversible thermosensitive recording medium according to the present invention is superior in terms of the instantaneous decolorization properties, and further, the durability and the light resistance.

Japanese Patent Application No. 11-251378 filed Sep. 6, 1999 is hereby incorporated by reference.

What is claimed is:

1. A reversible thermosensitive recording medium comprising a support, and a reversible thermosensitive recording layer formed thereon comprising:

a reversible thermosensitive coloring composition comprising an electron-donating coloring compound and an electron-accepting compound, which composition is capable of inducing color formation in said electron-donating coloring compound, capable of reversibly assuming a color-developed state or a decolorized state, depending upon the temperature of said reversible thermosensitive coloring composition when heated, and/or the cooling rate of said reversible thermosensitive coloring composition when cooled after the heating thereof, and a decolorization accelerating agent represented by formula (I):

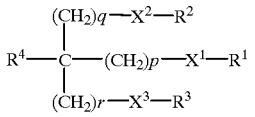

(I)

wherein p is an integer of 0 to 3; q and r are each independently an integer of 1 to 3; $X^1$, $X^2$, and $X^3$ are each a bivalent hetero-atom-containing group; $R^1$, $R^2$, and $R^3$ are each a hydrocarbon group having 1 to 22 carbon atoms, provided that at least one of $R^1$, $R^2$, or $R^3$ is an aliphatic hydrocarbon group having 8 or more carbon atoms; and $R^4$ is a hydrogen atom, hydroxyl group, or an aliphatic hydrocarbon group having 1 to 8 carbon atoms.

2. The reversible thermosensitive recording medium as claimed in claim 1, wherein p is 0 and q and r are 1 in formula (I).

3. The reversible thermosensitive recording medium as claimed in claim 2, wherein $R^1$, $R^2$, and $R^3$ are each a straight-chain aliphatic hydrocarbon group.

4. The reversible thermosensitive recording medium as claimed in claim 1, wherein $R^1$, $R^2$ and $R^3$ are each a straight-chain aliphatic hydrocarbon group.

5. The reversible thermosensitive recording medium as claimed in claim 1, wherein said reversible thermosensitive recording layer further comprises a cross-linked resin.

6. The reversible thermosensitive recording medium as claimed in claim 5, wherein said cross-linked resin comprises an isocyanate compound.

7. The reversible thermosensitive recording medium as claimed in claim 1, wherein said electron-accepting compound comprises a phenol compound having an alkyl chain with 8 or more carbon atoms.

8. The reversible thermosensitive recording medium as claimed in claim 1, wherein said reversible thermosensitive recording layer further comprises a color development and decolorization controlling agent which comprises a bivalent hetero-atom-containing group and an alkyl chain having 6 or more carbon atoms.

9. The reversible thermosensitive recording medium as claimed in claim 1, further comprising an organic or inorganic ultraviolet absorbing agent containing layer which is provided on said reversible thermosensitive recording layer.

10. The reversible thermosensitive recording medium as claimed in claim 1, further comprising a protective layer comprising a cross-linked resin which is provided on said reversible thermosensitive recording layer.

11. The reversible thermosensitive recording medium as claimed in claim 1, further comprising a magnetic recording layer which is provided on said support in such a manner that said magnetic recording layer and said reversible thermosensitive recording layer are arranged side by side on said support.

12. The reversible thermosensitive recording medium as claimed in claim 1, further comprising a magnetic recording layer which is provided between said support and said reversible thermosensitive recording layer.

13. The reversible thermosensitive recording medium as claimed in claim 1, further comprising a magnetic recording layer which is provided on the rear surface of said support, opposite to said reversible thermosensitive recording layer with respect to said support.

14. The reversible thermosensitive recording medium as claimed in claim 1, prepared in the form of a card or sheet.

15. The reversible thermosensitive recording medium as claimed in claim 14, further comprising a printing portion which is provided one at least one surface of said recording medium.

16. An image display apparatus for displaying an image, using as an image display medium a reversible thermosensitive recording medium comprising a support, and a reversible thermosensitive recording layer formed thereon comprising:

a reversible thermosensitive coloring composition comprising an electron-donating coloring compound and an electron-accepting compound, which composition is capable of inducing color formation in said electron-donating coloring compound, capable of reversibly assuming a color-developed state or a decolorized state, depending upon the temperature of said reversible thermosensitive coloring composition when heated, and/or the cooling rate of said reversible thermosensitive coloring composition when cooled after the heating thereof, and a decolorization accelerating agent represented by formula (I):

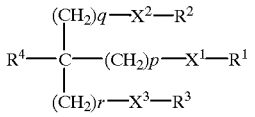

(I)

wherein p is an integer of 0 to 3; q and r are each independently an integer of 1 to 3; $X^1$, $X^2$, and $X^3$ are each a bivalent hetero-atom-containing group; $R^1$, $R^2$, and $R^3$ are each a hydrocarbon group having 1 to 22 carbon atoms, provided that at least one of $R^1$, $R^2$, or $R^3$ is an aliphatic hydrocarbon group having 8 or more carbon atoms; and $R^4$ is a hydrogen atom, hydroxyl group, or an aliphatic hydrocarbon group having 1 to 8 carbon atoms.

17. An image display method for displaying an image on a reversible thermosensitive recording medium, comprising the step of forming an image corresponding to output information in said reversible thermosensitive recording medium using a printer comprising means for imagewise heating said recording medium, said reversible thermosensitive recording medium comprising a support, and a reversible thermosensitive recording layer formed thereon comprising:

a reversible thermosensitive coloring composition comprising an electron-donating coloring compound and an electron-accepting compound, which composition is capable of inducing color formation in said electron-donating coloring compound, capable of reversibly assuming a color-developed state or a decolorized state, depending upon the temperature of said reversible thermosensitive coloring composition when heated, and/or the cooling rate of said reversible thermosensitive coloring composition when cooled after the heating thereof, and a decolorization accelerating agent represented by formula (I):

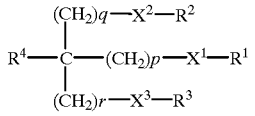

(I)

wherein p is an integer of 0 to 3; q and r are each independently an integer of 1 to 3; $X^1$, $X^2$, and $X^3$ are each a bivalent hetero-atom-containing group; $R^1$, $R^2$, and $R^3$ are each a hydrocarbon group having 1 to 22 carbon atoms, provided that at least one of $R^1$, $R^2$, or $R^3$ is an aliphatic hydrocarbon group having 8 or more carbon atoms; and $R^4$ is a hydrogen atom, hydroxyl group, or an aliphatic hydrocarbon group having 1 to 8 carbon atoms.

18. The image display method as claimed in claim 17, further comprising the step of erasing said displayed image by heating said image using said heating means.

19. The image display method as claimed in claim 17, further comprising the step of erasing said displayed image by heating said image using said heating means, said image forming step and said image erasing step being repeatedly carried out.

* * * * *